US006871936B2

(12) United States Patent
Fujimoto et al.

(10) Patent No.: US 6,871,936 B2
(45) Date of Patent: Mar. 29, 2005

(54) RECOVERING APPARATUS FOR RECOVERING A STATUS OF AN INK JET RECORDING HEAD

(75) Inventors: Hitoshi Fujimoto, Kawasaki (JP); Katsumi Sugiyama, Kawasaki (JP); Masataka Naito, Kawasaki (JP); Masatoshi Ikkatai, Yokohama (JP); Tsutomu Harada, Tokyo (JP); Tatsuya Fukushima, Kawasaki (JP); Takefumi Tamura, Tokyo (JP); Tsuyoshi Mikoshiba, Sagamihara (JP)

(73) Assignee: Canon Finetech Inc., Mitsukaido (JP)

( * ) Notice: Subject to any disclaimer, the term of this patent is extended or adjusted under 35 U.S.C. 154(b) by 0 days.

(21) Appl. No.: 10/414,071

(22) Filed: Apr. 14, 2003

(65) Prior Publication Data

US 2003/0202036 A1 Oct. 30, 2003

Related U.S. Application Data

(63) Continuation of application No. 08/401,995, filed on Mar. 10, 1995, now abandoned.

(30) Foreign Application Priority Data

Mar. 11, 1994 (JP) ..... 6-014612
Mar. 11, 1994 (JP) ..... 6-041614

(51) Int. Cl.[7] ..... B41J 2/165
(52) U.S. Cl. ..... 347/33; 347/29
(58) Field of Search ..... 347/29–34, 22, 347/48, 18

(56) References Cited

U.S. PATENT DOCUMENTS 4,313,124 A 1/1982 Hara ..... 347/57
4,345,262 A 8/1982 Shirato et al. ..... 347/10

(Continued)

FOREIGN PATENT DOCUMENTS

| | | |
|---|---|---|
| EP | 0 380 056 | 8/1990 |
| EP | 0 510 894 | 10/1992 |
| EP | 0 580 437 | 1/1994 |
| EP | 0 754 553 | 1/1997 |
| JP | 54-56847 | 5/1979 |
| JP | 59-123670 | 7/1984 |
| JP | 59-138461 | 8/1984 |
| JP | 60-71260 | 4/1985 |
| JP | 2-179749 | 7/1990 |
| JP | 2-179755 | 7/1990 |
| JP | 2-179757 | 7/1990 |
| JP | 2-198846 | 8/1990 |
| JP | 2-198847 | 8/1990 |
| JP | 2-202452 | 8/1990 |
| JP | 3-187761 | 8/1991 |
| JP | 3-227659 | 10/1991 |
| JP | 4-235039 | 8/1992 |
| JP | 4-235056 | 8/1992 |
| JP | 4-247955 | 9/1992 |
| JP | 5-286144 | 11/1993 |
| JP | 6-964 | 1/1994 |

*Primary Examiner*—Hai Pham
(74) *Attorney, Agent, or Firm*—Fitzpatrick, Cella, Harper & Scinto

(57) ABSTRACT

In a recovering apparatus for recovering ink ejecting ports forming a plane of an ink jet head, an ink absorbing member is disposed inward of a cap and proximate to the ink ejecting ports, facing the ink ejecting ports at a predetermined distance therefrom. Large ink droplets or water droplets adhering to the ink ejecting ports are then absorbed in the absorbing member. Thereafter, the plane of the ink jet heads with the ink ejecting ports is cleanly wiped by a wiping member, thereby preventing scattering of ink droplets or water droplets away from the ink ejecting ports. A trough is located adjacent to each head, and the recovering apparatus is disposed with respect to the trough so that a distance between the recovering apparatus and the ink jet head can be reduced, thereby permitting a compact arrangement of the recovering apparatus and the ink jet head.

9 Claims, 33 Drawing Sheets

U.S. PATENT DOCUMENTS

| | | | | |
|---|---|---|---|---|
| 4,459,600 | A | 7/1984 | Sato et al. | 347/47 |
| 4,463,359 | A | 7/1984 | Ayata et al. | 347/56 |
| 4,558,333 | A | 12/1985 | Sugitani et al. | 347/65 |
| 4,608,577 | A | 8/1986 | Hori | 347/66 |
| 4,723,129 | A | 2/1988 | Endo et al. | 347/56 |
| 4,740,796 | A | 4/1988 | Endo et al. | 347/56 |
| 4,951,066 | A | 8/1990 | Terasawa et al. | 347/33 |
| 5,055,861 | A | 10/1991 | Murayama et al. | 347/29 |
| 5,231,423 | A * | 7/1993 | Wataya et al. | 347/18 |
| 5,270,738 | A | 12/1993 | Takahashi et al. | 347/29 |
| 5,381,169 | A | 1/1995 | Arai et al. | 347/33 |
| 5,483,267 | A | 1/1996 | Nemura et al. | 347/32 |
| 5,530,462 | A | 6/1996 | Takahashi et al. | 347/23 |
| 5,555,461 | A | 9/1996 | Ackerman et al. | 347/33 |
| 5,670,997 | A | 9/1997 | Sugimoto et al. | 347/30 |
| 5,757,399 | A | 5/1998 | Murayama et al. | 347/32 |

* cited by examiner

RECOVERING APPARATUS FOR RECOVERING A STATUS OF AN INK JET RECORDING HEAD

BACKGROUND OF THE INVENTION

This application is a continuation of U.S. application Ser. No. 08/401,995, filed Mar. 10, 1995, now abandoned.

FIELD OF THE INVENTION

The present invention relates generally to a label printer widely used in the field of, e.g., POS (point of sale), FA (factory automation), physical distribution or the like. More particularly, the present invention relates to a label printer having an ink jet printing system employed therefor.

DESCRIPTION OF THE RELATED ART

A label printer having an ink jet printing system utilized therefor has not been put in practical use till now. General advantages obtainable from ink jet recording are as noted below. Specifically, one of them is that ink jet printing is effected with excellent quietness attributable to no contact with a printing medium, other one is that ink jet printing is performed at a high speed, another one is that ink jet printing can be achieved at a high density, further one is that ink jet color printing can easily be realized, and an ink jet printing apparatus can be designed with small dimensions.

A conventional label printer is usually constructed such that so-called label paper unwound from a roll is conveyed through a printing section, and the roll is prepared in such a manner that a number of labels are successively adhesively placed on a long peeling sheet that is called a separator in the equally spaced relationship. In the case that the ink jet system is applied to the label printer of the foregoing type, it is required to take a measure for suppressively preventing the label paper from being floated up at a printing head, and moreover, being slantwise conveyed.

Lately, there is a tendency that the number of bar codes becomes short. For this reason, colored bar code is taken into account. In this circumstances, it is advantageous to employ the ink jet system. In the case that a color label printer is designed, when a printing speed is set to a high level, a printing signal to be applied to each color printing head has an increased frequency, causing a necessity to arise for enlarging the capacity or a driving power source. This leads to problem that a size of the power source is enlarged, and the color label printer is produced at an increased cost.

In the case that the ink jet system is employed for a label printer and the label printer is left unused for a long time, to prevent ink from being unstably ejected, it is advantageous that ink present in the vicinity of a printing head is caused to recirculate with the aid of a so-called recovering system. A recovering operation is generally achieved by bringing a recovering unit in contact with or in close vicinity to a printing head that is printing means. However, since roll-shaped label paper is usually used for the label printer, there does not arise an occasion that the paper to be printed disappears from the printing position. Therefore, in contrast with a printer operable with cut printing papers like an ordinary office-use printer, it is very difficult to arrange a recovering system and design a recovering sequence.

In this connection, it is also very difficult to compactly design and construct a printing head, a recovering system unit, an ink feeding system, and a printing medium conveying system.

SUMMARY OF THE INVENTION

The present invention has been made in consideration of the aforementioned background.

An object of the present invention is to provide a recovering apparatus which can wipe the ink ejecting ports forming plane of ink jet head effectively.

Another object of the present invention is to provide a small printer which has a plurality of ink jet heads and a plurality of recovering means maintaining the ink ejecting status of the heads under good condition, and which has higher printing productivity because of the small moving range of the heads and the recovering means.

In a first aspect of the present invention, there is provided a recovering apparatus for recovering an ink jet head (5) to maintain an ink ejecting state under a good condition, comprising;

setting means for setting an absorbing member (26) at the opposing position of the head with a predetermined gas between ink ejecting ports of the ink jet head (5) and the absorbing member (26), and a wiping member (24) adapted to come in contact with ink ejecting ports forming plane of the ink jet head to wipe it therewith.

Here, recovering apparatus may further comprise;

means for controlling the pressure of ink to be fed to the ink jet head, and means for absorbing the ink discharged from the ink jet head (5) by the foregoing pressure controlling in the absorbing member, with the aid of the setting means.

Large-sized liquid droplets adhering to the ink jet ejecting ports forming plane may be absorbed in the absorbing member (26) with the aid of the setting means.

A wiping operation may be performed by the wiping member (24) after ink is absorbed in the absorbing member (26).

The recovering apparatus may further comprise a cap (25) for capping the ink ejecting ports forming plane of the ink jet head (5), the cap (25) includes the absorbing member, and the capping is achieved by the setting means.

A plurality of recovering means (3) arranged corresponding to a plurality of ink jet heads (5) for maintaining ink ejecting state of the ink jet heads (5) under a good condition may be located in a spaced relationship while spaces between adjacent recovering means enable an ink ejecting ports side of each of the ink jet heads (5) to pass therethrough.

The recovering apparatus may further comprise holding means (38) for holding the plurality of recovering means (3) with the same pitch as that of arrangement of the plurality of ink jet heads (5) in the spaced relationship.

The holding means (38) may include a plurality of opening portions each capable of allowing each of the plurality of ink jet heads to be inserted therethrough, and each of the recovering means is disposed adjacent to each opening portion of the holding means.

The recovering means (3) may include a cap (25) for capping the ink ejecting ports forming plane, a wiping member (24) for wiping the ink ejecting ports forming plane, and an absorbing member (26) for receiving ink discharged from ink ejecting ports.

The recovering apparatus may further comprise;

first displacing means disposed at the position where the ink jet head (5) faces to the recovering means (3), for relatively displacing the holding means (5) and the ink jet head (5), and second displacing means for displacing the ink jet head (5) in the reverse direction to the direction of inserting the ink ejecting ports side through the space.

The plurality of ink jet heads (5) may eject inks each having a different color.

In a second aspect of the present invention, there is provided a printer for performing a printing operation using a plurality of ink jet heads (5), comprising recovering apparatus.

A surface of a printing medium may be to be inserted through the gap at the position facing to an ink ejecting surface.

The ink jet heads (5) may include elements for generating thermal energy to be utilized for the purpose of ink ejection.

In a fourth aspect of the present invention, there is provided a method of recovering an ink jet head (5) for maintaining an ink ejecting state under a good condition, comprising the steps of;

setting an absorbing member (26) at the position where ink ejecting ports of the ink jet head (5) face to the absorbing member (26) with a predetermined distance, and bringing a wiping member (24) in contact with ink ejecting ports forming plane of the ink jet head to wipe it after completion of the setting step.

The recovering method may further comprise a step of controlling the pressure of ink to be fed to the ink jet head (5), and the setting step serves to absorb in the absorbing member (26) the ink discharged on completion of the controlling step.

The setting step may serve to absorb in the absorbing member (26) large liquid droplets adhering to the ink ejecting ports forming plane of the ink jet head.

A cap (25) for capping the ink ejecting ports forming plane of the ink jet head may include the absorbing member (26), and the setting steps serves also as a step of allowing the ink ejecting ports forming plane of the ink jet head (5) to be capped with the cap (25).

According to the present invention, an ink absorbing member comes near to an ink ejecting ports of the ink jet head with the small gap. By controlling the pressure of the ink fed to the ink jet head, ink is discharged.

A large-sized liquid droplet can be absorbed in the absorbing member by sufficiently reducing a gap between ink ejecting ports of ink jet head and the absorbing member.

Further, since the absorbing member is disposed in a cap serving to cap the ink ejecting ports forming plane of the ink jet head, large ink droplets or water droplets adhering to the ink ejecting port forming plane due to deposition of ink mist or dewing on the same can be absorbed in the absorbing member in the capping state. The ink ejecting ports forming plane can be maintained under a good condition by bringing a wiping member in contact with the ink ejecting ports forming plane so as to wipe the plane with the wiping member.

Additionally, according to the present invention, the recovering apparatus includes a plurality of ink jet heads and a plurality of recovering means corresponding to the ink jet heads, and the recovering means are arranged with a narrow space between adjacent recovering means enough for the ink ejecting port side of each ink jet head to pass therethrough. With this construction, heads located in the space portions can face to the recovering means by moving the recovering means for small amount since each of the heads and each of the recovering means are closed.

BRIEF DESCRIPTION OF THE DRAWINGS

FIG. 21 is a flowchart which shows treatments to be conducted by the label printer after a power source is turned on.

FIG. 22 is a flowchart which shows the content of recovering treatments to be conducted while the power source is turned on.

DESCRIPTION OF THE PREFERRED EMBODIMENTS

The present invention will now be described in detail hereinafter with respect to the following items with reference to the accompanying drawings which illustrate preferred embodiments thereof.

(1) Outline of the structure of a label printer to which the present invention is applied (see FIG. 1 to FIG. 3)
(2) Printing head station (see FIG. 4 to FIG. 11)
  (2.1) Whole structure of the printing head station (see FIG. 4 and FIG. 6)
  (2.2) Head block (see FIG. 6)
  (2.3) Recovering system unit (see FIG. 7 to FIG. 10)
  (2.4) Cooling unit (see FIG. 11)
(3) Printing medium conveying mechanism (see FIG. 12 to FIG. 14)
  (3.1) Roll feeding unit
  (3.2) Conveying unit
  (3.3) Cutter unit
  (3.4) Other embodiment of the roll feeding unit
(4) Ink system (see FIG. 15 to FIG. 19)
(5) Hardware for a controlling system (see FIG. 20)
(6) Precedent treatment for blank paper and subsequent treatment for blank paper
(7) Recovering treatment for a printing head (see FIG. 21 to FIG. 35)
  (7.1) Recovering treatment to be conducted when a power source is turned on
  (7.2) Recovering treatment to be conducted before a printing operation is performed
  (7.3) Recovering treatment to be conducted in the course of a printing operation
  (7.4) Controlling to be effected for an air cooling fan
  (7.5) Small-scaled recovering treatment, middle-scaled recovering treatment and large-scaled recovering treatment
(8) Others Incidentally, terms "printing" and "recording" are used throughout the specification of the present invention, and it should widely be construed that these terms mean that a printing agent is applied to a printing medium.

In each embodiment to be described later, roll-shaped paper having a series of labels continuously arranged on peelable paper is used as a printing medium. However, any type, kind and material may be employed for the printing medium corresponding to a printer. For example, a cut paper sheet may be used as a printing medium. Otherwise, a film, a cloth or a similar one may be used as a material for the printing medium.

The present invention will be described below with respect to the case tat it is applied to a label printer, it of course is obvious that a printer may be designed in a various type, e.g., in the form of a printer having a continuous perforated paper sheet, a name card, an ordinary card or the like used as a printing medium or in the form of a ticket vending machine.

(1) Outline of the Structure of a Label Printer.

Figure 1:
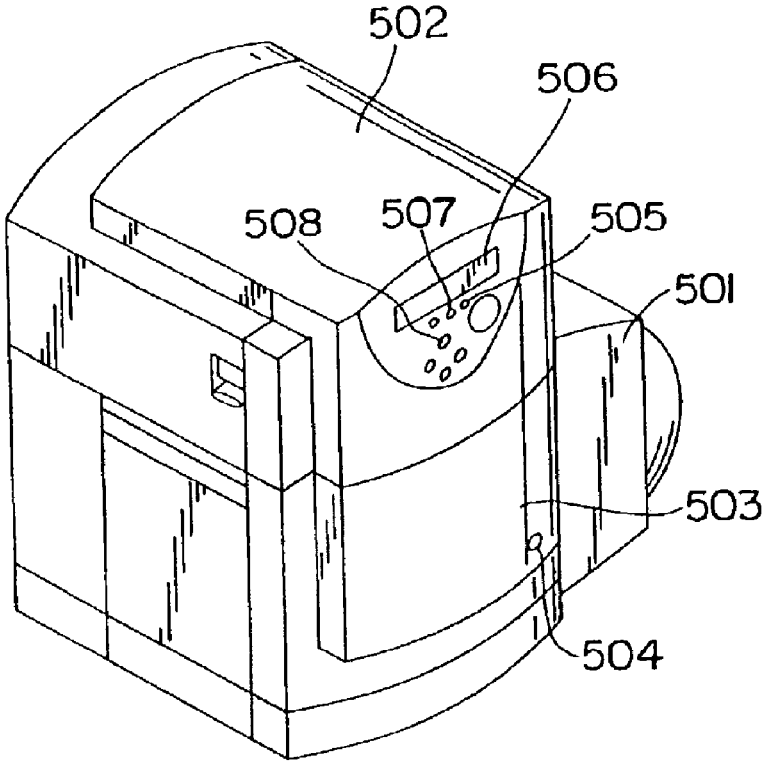
FIG. 1 is a perspective view of a label printer, showing the structure of the label printer.

FIG. 1 is a perspective view which shows appearance of a label printer constructed in accordance with an embodiment of the present invention. In FIG. 1, reference numeral 501 denotes a roll paper feeding cover for receiving a paper roll therein, reference numeral 502 denotes a cover for opening and closing a conveying section for the paper roll and having a printing head station accommodated therein, and reference numeral 503 denotes a front cover for exposing respective ink tank portions to the outside. Reference numeral 504 denotes a power source switch for the printer, reference numeral 505 denoted a READY lamp adapted to be turned on when the printer is ready to be used, reference numeral 506 denotes a liquid crystal panel for displaying messages each informing an operator of the present state of the label printer, e.g., an error message or a similar one, reference numeral 507 designates an ERROR lamp adapted to be turned on when a certain abnormality occurs with the label printer, and reference numeral 508 denotes an ONLINE lamp adapted to be turned on when the label printer is held in the online state relative to a host system (no shown).

Next, fundamental operations to be performed by the label printer constructed in the aforementioned manner will be described below.

At the Time when the Power Source is ON or OFF:

While the roll paper feeding cover 501, the opening/closing cover 502 and the front cover 503 are kept closed, the power switch 504 is shifted to ON. At this time, the READY lamp 505 is flickeringly lighted, causing to check respective sections on the label printer. When it is found on completion of the checking operation that no abnormality occurs with the label printer, the READY lamp is shifted to the normally lighting state after several seconds elapse, whereby the label printer is brought in the mode preset by a user. In case that it is found that abnormality occurs with he label printer, an error message is displayed on the liquid crystal panel 506. This causes the ERROR lamp is lighted. On the other hand, when the power source is to be turned off, it is sufficient that the power source switch 504 is depressed with a user's finger.

When the Label Printer is Held in the Online or Offline Mode:

The online mode can visually be recognized based on the state that the ONLINE lamp 508 is lighted, and the offline mode can visually be recognized based on the state that the ONLINE lamp 508 is turned off. When the label printer is held in the online mode, it can be controlled by the host system, and when the label printer is held in the offline mode, a various kind of operation can be performed by handling an operation panel for the label printer.

Figure 2:
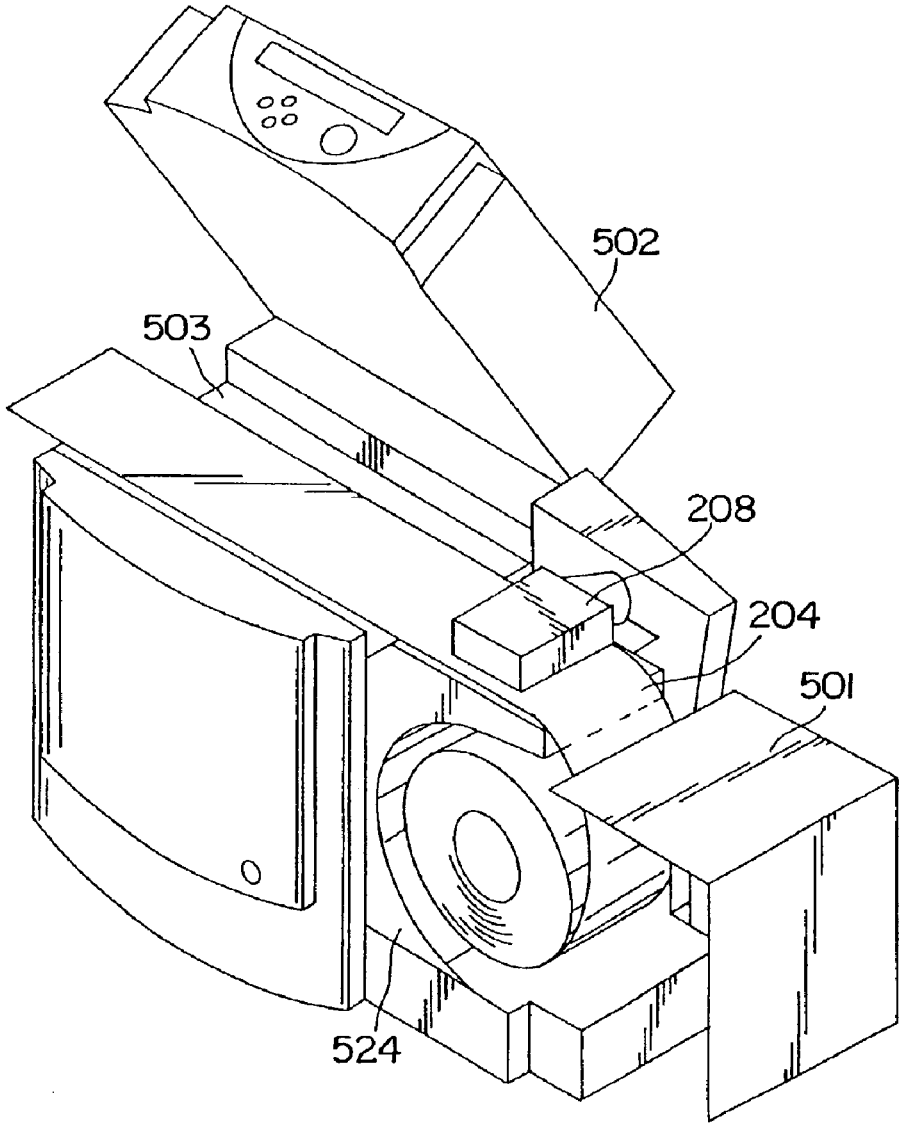
FIG. 2 is a perspective view of the label printer, illustratively showing in the disassembled state how roll-shaped paper is fitted to the label printer.

Method of Fitting a Paper Roll to the Label Printer:

Next, a method of fitting a paper roll to the label printer will be described below with reference to FIG. 2. The paper roll is exchanged with other one by way of the following procedure.

The roll paper feeding cover 501 is opened.

A slantwise conveying unit 208 is raised up with operator's fingers.

A paper roll 204 is taken out of the housing of the label printer (in the case that no paper roll is present, this step of operation is not required).

A new paper roll 204 is inserted into a roll feeding holder 524, an adequate quantity of paper is extensively drawn from the paper roll 204 at the fore end part of the latter, it is placed below the slantwise conveying unit 208, and thereafter, the slantwise conveying unit 208 is lowered.

The cover 501 is restored to the original position so that it is held in the closed state.

Figure 3:
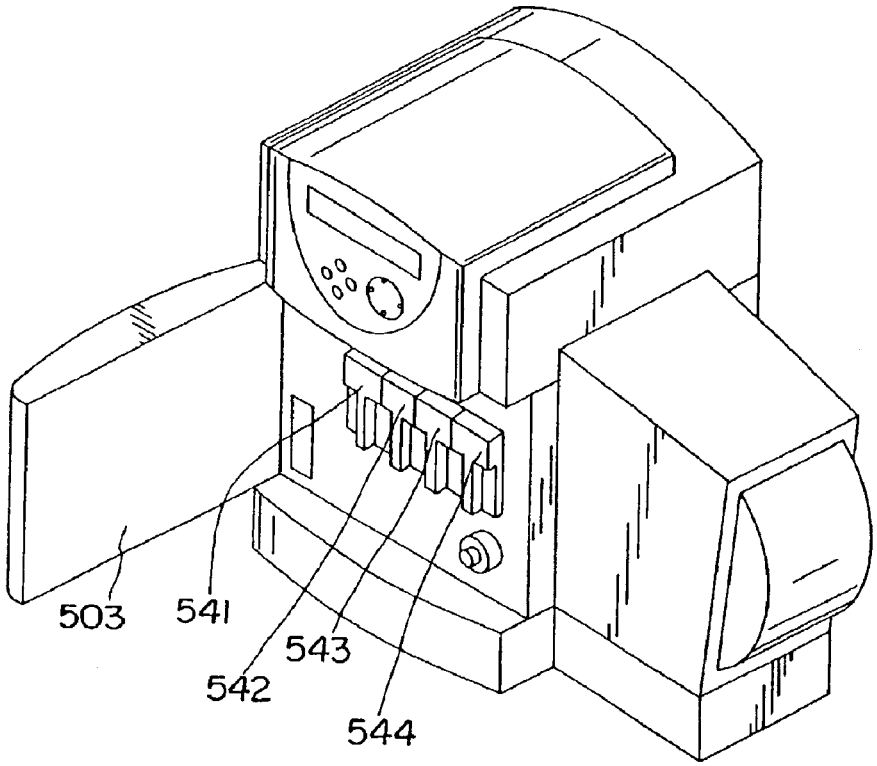
FIG. 3 is a perspective view of the label printer, showing how ink cartridges are exchanged with another ones.

Exchanging of an Ink Cartridge with a New One:

A method of exchanging an ink cartridge serving as an ink supply source with a new one will be described below with reference to FIG. 3. In practice, the ink cartridge is exchanged with a new one by way of the following procedure.

The front cover 503 is opened.

An ink cartridge 306 to be exchanged with a new one is drawn out of the housing of the label printer (In the case that no ink cartridge is fitted into the label printer, this operation is not required).

A new cartridge 306 is inserted into a predetermined color cartridge inserting portion. In the shown case, ink cartridges are arranged in accordance with the order of a yellow ink cartridge (Y) 541, a magenta ink cartridge (M) 542, a cyan ink cartridge (C) 543 and a black ink cartridge (Bk) 544 as viewed on the left-hand side of the label printer.

On completion of the exchanging operation, the front cover 503 is closed.

Figure 4:
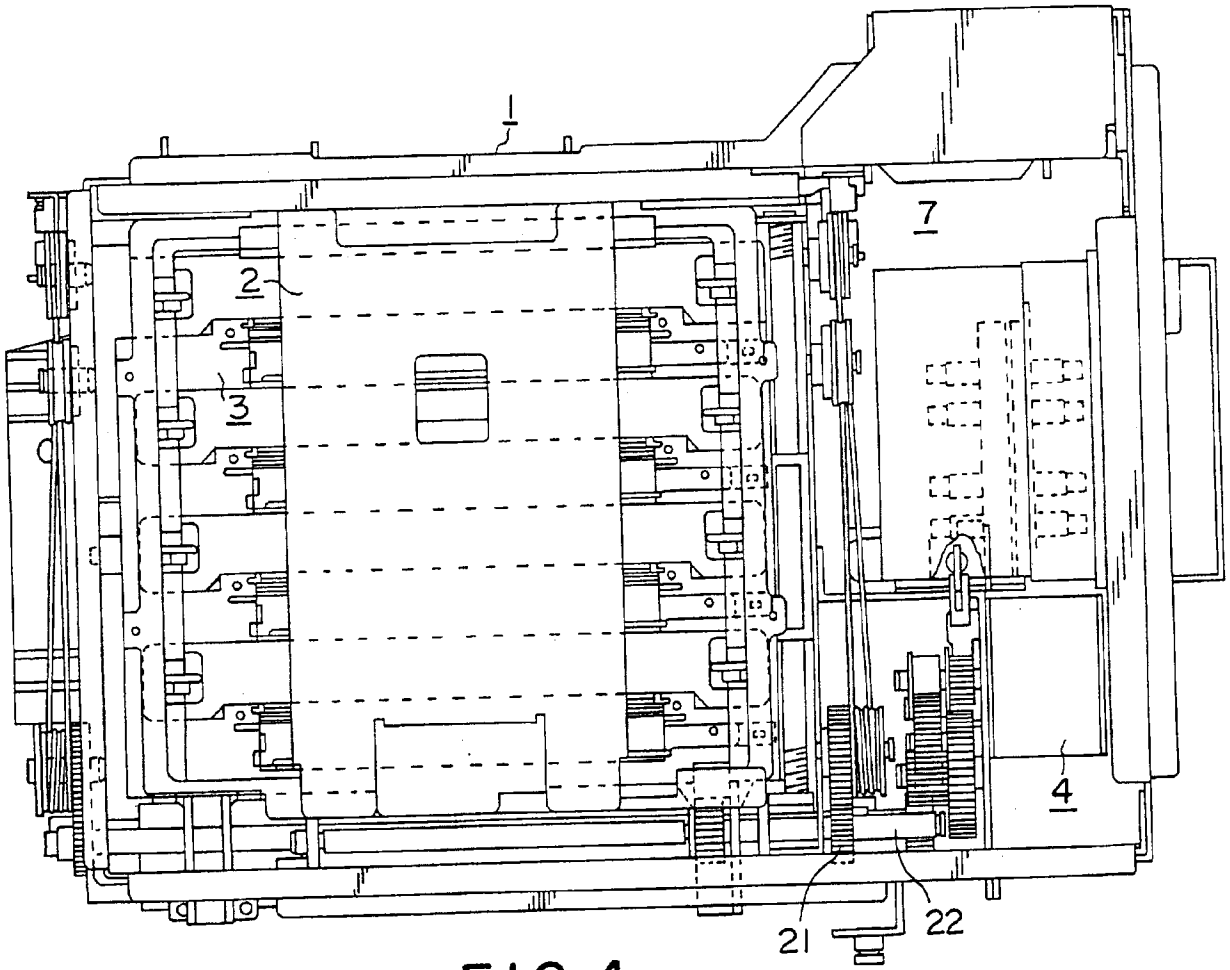
FIG. 4 is a plan view of the label printer, showing by way of example the structure of a printing head station.
Figure 5:
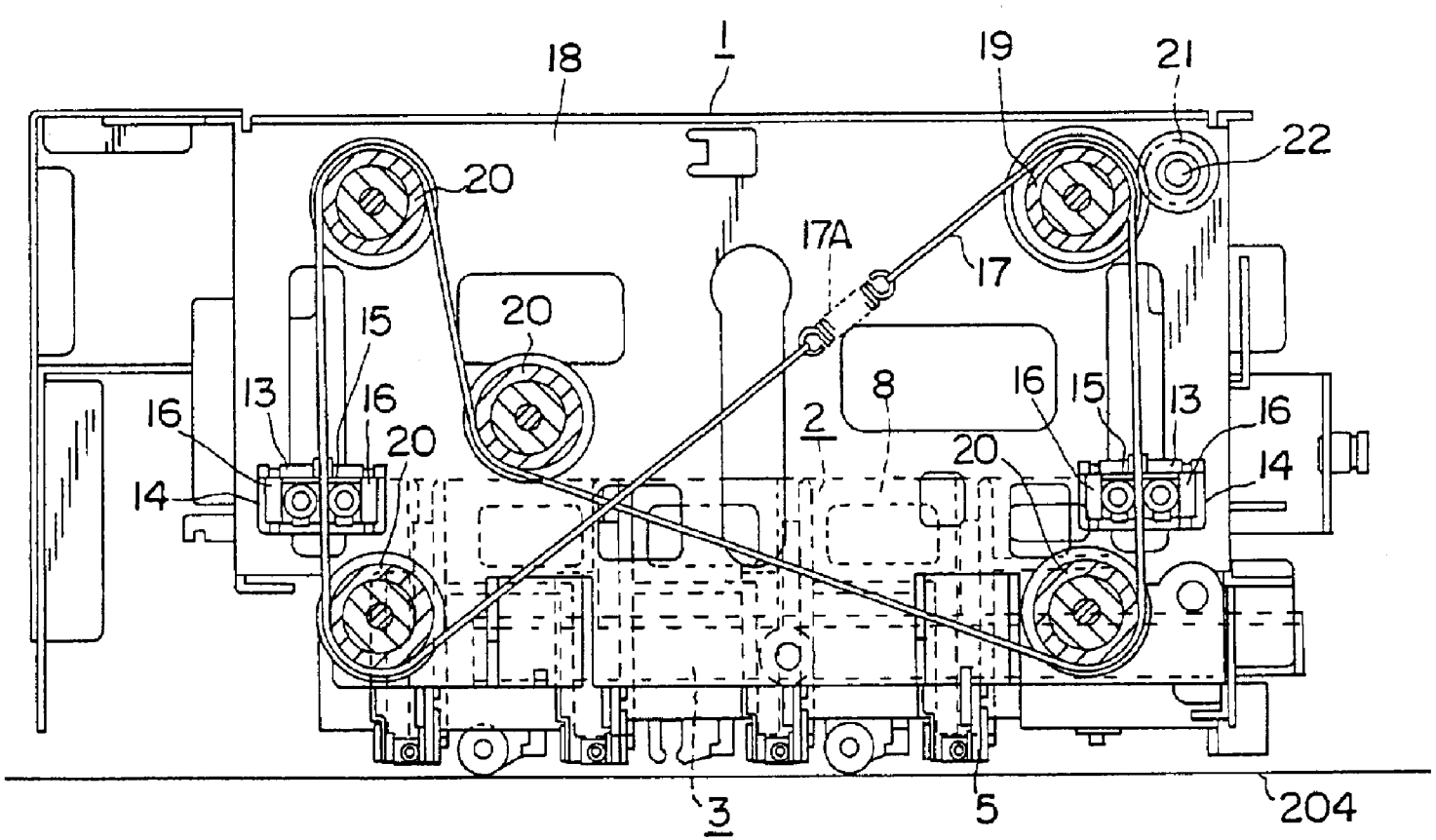
FIG. 5 is a front view of the label printer, showing by way of example the structure of the printing head station.

(2) Printing Head Station (2.1) Whole structure of the printing head station:

FIG. 4 is a plan view which shows by way of example the structure of a printing head station (hereinafter referred to simply as PHS) arranged in the cover 502 while exposing to a conveying path for unrolled paper, and FIG. 5 is a front view of the PHS.

To perform a printing operation for a label placed on part of the unrolled paper 204, PHS 1 includes a head unit 2 having a plurality of ink jet heads (hereinafter referred to simply as a head) 5 arranged therefor (corresponding to e.g. four kinds of colors), and each of the heads 5 includes a number of ink ejecting ports arranged within the range in excess of the whole width of the label as measured in the transverse direction of the unrolled paper 204. For example, a bubble jet type head as proposed by Canon Inc. including a number of elements each adapted to generate thermal energy as energy to be utilized for ink ejection by allowing a phenomenon of film boiling to appear in ink can be used as each head 5.

In addition, PHS 1 includes collecting means for recoverably collecting ink discharged from the respective ink ejecting port side arranged on the head 5, cleaning means for removing ink remaining on an ejecting port forming plane in the vicinity of the ink ejecting ports by wiping it, and a recovering system unit 3 including capping means for preventing the respective ink ejecting ports from being dried. Further, PHS 1 includes a driving unit 4 for vertically displacing the head holder unit 2 from the printing position for the unrolled paper 204, and moreover, horizontally displacing the recovering system unit 3 by a predetermined quantity in the conveying direction of the unrolled paper 204 and a cooling unit 7 for cooling the head 5.

(2.2) Head Block

Figure 6:
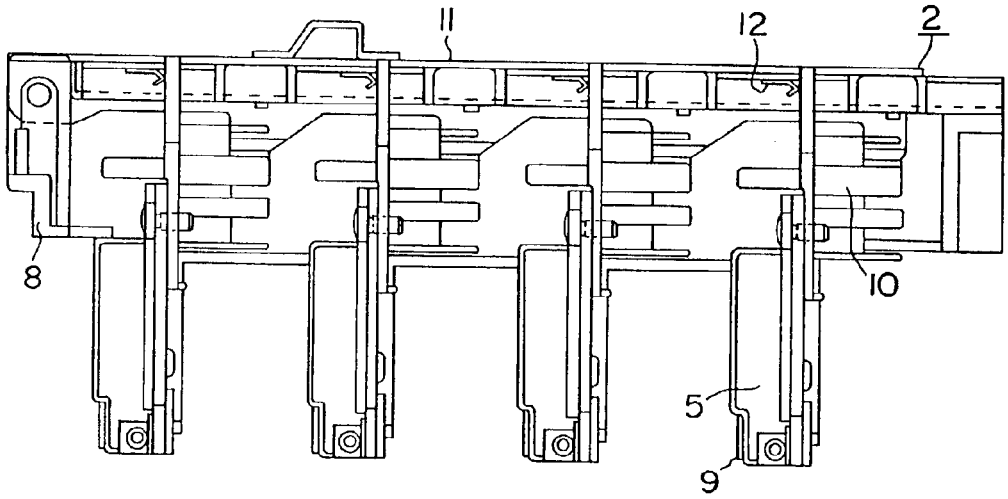
FIG. 6 is a fragmentary front view of the label printer, showing the structure of a head block.

FIG. 6 is a front view of a head block which includes a plurality of heads 5 and a holder 8 for each head 5. In the shown case, four heads 5 are arranged on the head holder 8 in the equally spaced relationship in the conveying direction of the unrolled paper. Each head 5 includes a plurality of ink ejecting ports facing to the unrolled paper, an ink absorbing member 9 disposed on the side surface of the head at the lover end part of the latter, and heat radiating fins 10 disposed at the upper part of the head 5. A head thrusting spring 12 is attached to a retaining plate 11 for the head holder 8 so that each head 5 is biased in a predetermined direction so as to allow the position to be occupied by the head 5 to be determined.

Four raising/lowering arms 13 are attached to the head holder 8 at corners. As shown in FIG. 5, the raising/lowering arms 13 are projected outside of a PHS holder 18 forming an outer shell of the PHS 1. The projected portion of the raising/lowering arms 13 is connected to a wire 17 via a raising/lowering plate 14, a stationary plate 15 and springs 16 so as to allow the head holder 8 to be vertically displaced relative to the unrolled paper 204 serving as a printing medium. The wire 17 extends around a geared pulley 19 and three pulleys 20 disposed on the left-hand and right-hand outer sides of the PHS holder 18, and the opposite ends of the wire 17 are connected to each other with an adjusting spring 17A interposed therebetween. The geared pulley 19 transmits power from a driving unit 4 to the wire 17 via a driving gear 21 and a driving shaft 22, whereby the wire 17 is displaced by these pulleys 19 and 20, causing the head holder 8 to be raised or lowered.

(2.3) Recovering System Unit

Figure 7A:
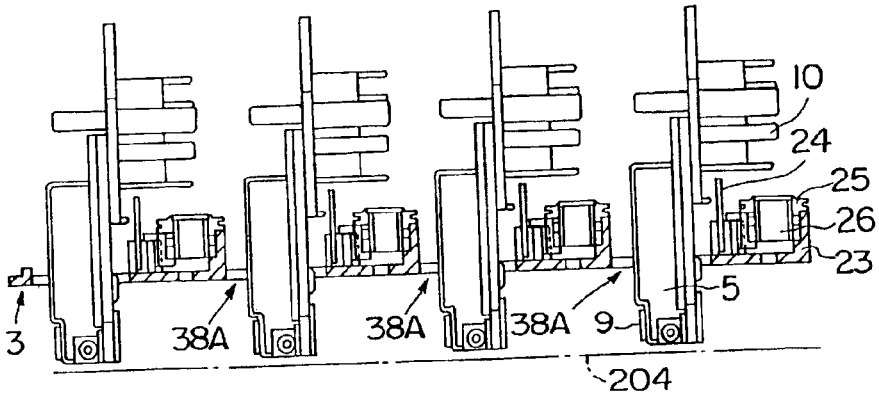
FIG. 7A and FIG. 7B are sectional views which show ink jet heads and recovering units, respectively.
Figure 7B:
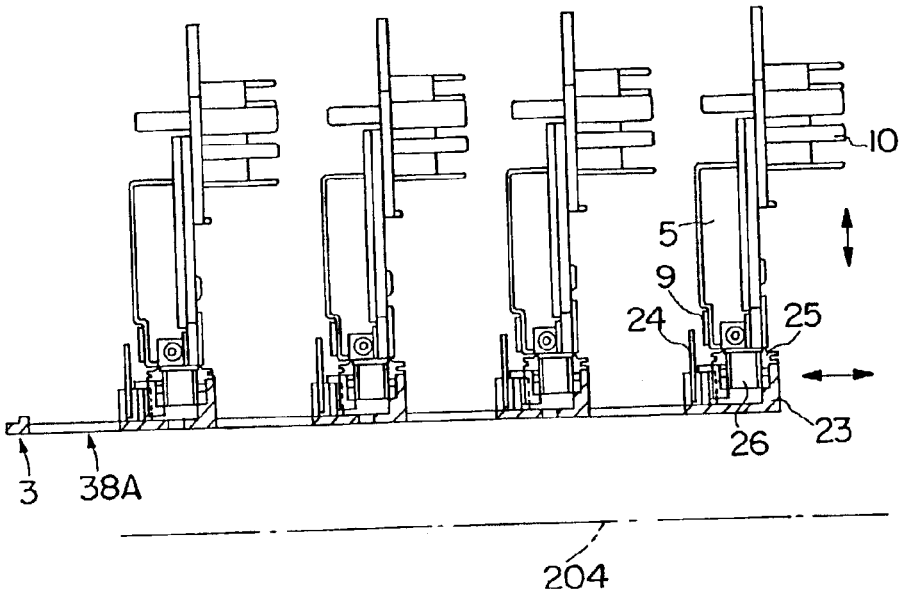
Figure 8:
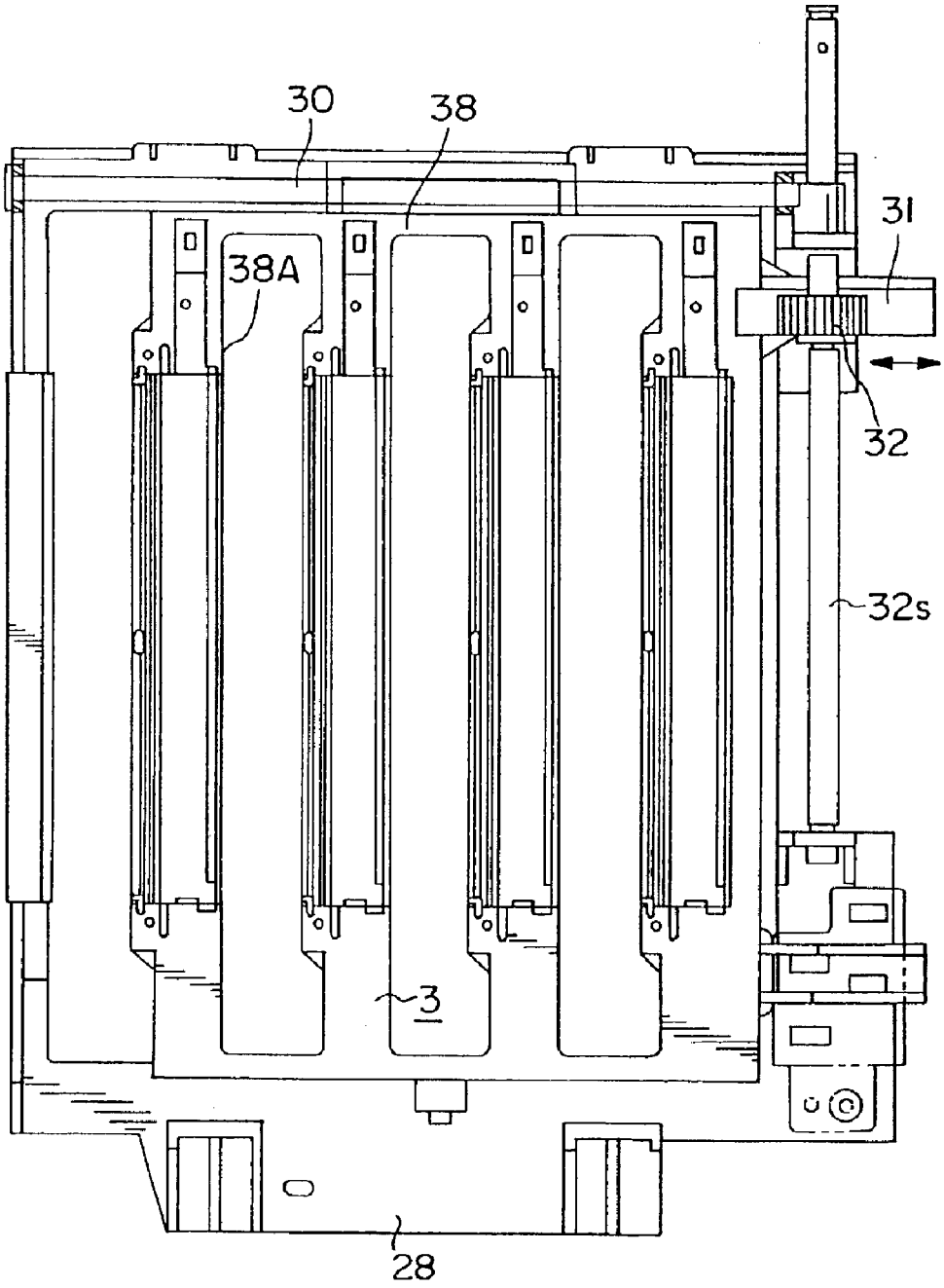
FIG. 8 is a plan view of the recovering units.

FIG. 7A and FIG. 7B are schematic sectional views which show a plurality of heads 5 and a recovering system unit 3, respectively, and FIG. 8 is a plan view of the recovering system unit 3.

The recovering system unit 3 includes a slotted member 38 having a plurality of openings 38A formed therethrough and a plurality of trough portions 23 each disposed adjacent to the each opening 38A to serve as recovering means. The number of opening 38A is equal to that of the heads 5, and each opening 38A is designed in such a manner as to enable part of each head 5 on the ink ejection port side to be inserted therethrough. The recovering system unit 3 can reciprocably be displaced in parallel with the conveying direction (in the leftward/rightward direction in FIG. 7B) of the unrolled paper 204. Each trough portion 23 includes a cap 25 molded of an elastic material such as rubber or the like of which edge portion can surround the peripheral of ink ejection port of each head 5 therewith by coming in contact with an ink ejection port forming surface of the head 5. While the edge portion of the cap 25 comes in contact with the ink ejection port forming surface, the interior of the trough 23 can be held in the sealed state by deflection of the edge portion of the cap 25.

An ink absorbing member 26 is received in each cap 25, and at the time of capping, the ink absorbing member 26 faces to the ink ejection port forming surface with a predetermined distance therebetween. Since the ink absorbing member 26 is disposed in that way, it can absorb ink discharged from the head 5 not only at the time of preliminary ejection to be described later but also at the time of ink recirculation conducted under pressure controlling of the ink system for each head 5. In addition, while the absorbing member 26 is held in the capping state, it can absorb large-sized ink droplets or water droplets adhering to the ink ejection port forming surface in the presence of ink mist or due to dewing. Since each cap 25 is constructed and controlled in such a manner as not to allow the ink absorbing member 26 to come in contact with the ink ejection port forming surface while the cap 25 is held in the capping state, there does not arise a problem that each ink ejection port is clogged with small pieces peeled from the ink absorbing member 26. Absorbed ink is discharged from a discharge port formed on the lower end of the absorbing member 26 by driving a pump or a similar unit. In an embodiment to be described later, both of pressurizing and sucking are employed for controlling the pressure for the recirculation of the ink system. However, one of them may be employed.

In FIGS. 7A and 7B, reference numeral 24 denotes a blade disposed sideward of the absorbing member 26 to serve as wiping means. To wipe the ink ejection port forming surface of each head 5 to remove fine ink droplets and water droplets (ink droplets and water droplets which cannot be absorbed in the absorbing member 26) adhering to the ink ejection port forming surface, the blade 24 is molded of an elastic material. In this embodiment, since the blade 24 wipes only comparatively small-sized ink droplets and water droplets, it can suppressively prevent them from being scattered away therefrom.

If ink droplets to be wiped by the blade 24 are large in size to some extent, they fall down in the trough 23 directly from he blade 24. On the other hand, small-sized droplets are removed by cleaning the opposite side surfaces of the blade 24 with the aid of blade cleaning means such as an absorbing member or the like disposed between adjacent heads.

In addition, an ink absorbing member 9 is disposed on the opposite side to the blade 24 so as to prevent the ink ejection port forming surface from being contaminated by the blade 24 by cleaning the latter again with the ink absorbing member 9 directly before each head 5 is wiped.

The recovering system unit 3 is supported on a recovering plate 28 to slidably move along a guide shaft 30 extending in the conveying direction of the unrolled paper, with the aid of rolling rollers or the like. The displacement of the recovering system is carried out by combination of a rack 31 with a pinion 32. The rack 31 is made integral with the recovering plate 28, and the pinion 32 is mounted on a recovering system driving shaft 32*s*. Required power is transmitted from a driving system unit 4 to the recovering system unit 3 via the recovering system driving shaft 32*s*.

FIG. 7A shows the state that each head 5 is displaced in the downward direction to be projected outside of the opening 38A or the slotted member 38, and FIG. 7B shows the state that the ink ejection forming surface of each head 5 is capped with the cap 25. In the shown case, a plurality of troughs 23 each serving as recovering means are arranged in the equally spaced relationship with a wide distance enough to allow at least the whole ink ejection portion of each head 5 to pass between adjacent troughs 23, and the holder 8 is constructed such that the heads 5 are arranged in consideration of the aforementioned arrangement of the troughs 23. Thus, a quantity of relative displacement of the heads 5 and the recovering system units 3 between the printing position and the capping position as viewed in the horizontal direction (a quantity of displacement of the recovering system units 3 in this embodiment) as well as a time required for conducting the foregoing displacement can be reduced, whereby the whole label printer can compactly be constructed and productivity of each printing operation can be improved. This is because, it is sufficient that the recovering system unit 3 can be displaced between the position where the slotted gap between adjacent troughs 23 faces to the head 5 and the position where the cap 25 received in the trough 23 faces to the head 5.

On the contrary, in the case that a plurality of recovering means are not arranged with a predetermined distance between adjacent recovering means, each head 5 can not be inserted through the slotted gap between adjacent recovering means. Thus, it is unavoidable that a quantity of relative displacement of each head and each recovering system unit is increased. In other words, a space required for escapably displacing the whole recovering system units from the range where a plurality of heads are arranged becomes undesirably necessary. Because of this necessity, the whole label printer is designed and constructed with large dimensions, and moreover, the time required for conducting the foregoing escapable displacement is largely elongated.

In this embodiment, to cool each head 5, a fin 10 extending in the direction of air blowing effected by a cooling unit 7 (i.e., in the direction perpendicular to the paper surface as viewed in FIG. 7) is disposed at the upper part of the head 5 (on the opposite side to the range where ink ejection ports are disposed) Since air blowing is effected along the cooling fin 10 in parallel to the same, few air reaches the ink ejection port side with few possibility that ink ejection is adversely affected. Additionally, in this embodiment, since each trough 23 serving as recovering means is located between adjacent heads 5 at the printing position (see FIG. 7A), the ejecting port forming plane on the head is effectively shielded from the blowing of the cooling air without any possibility that the ink ejection state is undesirably disturbed.

FIGS. 9A to 9D are schematic views which explain the positional relationship between the head 5 and the trough 23, respectively.

Figure 9A:
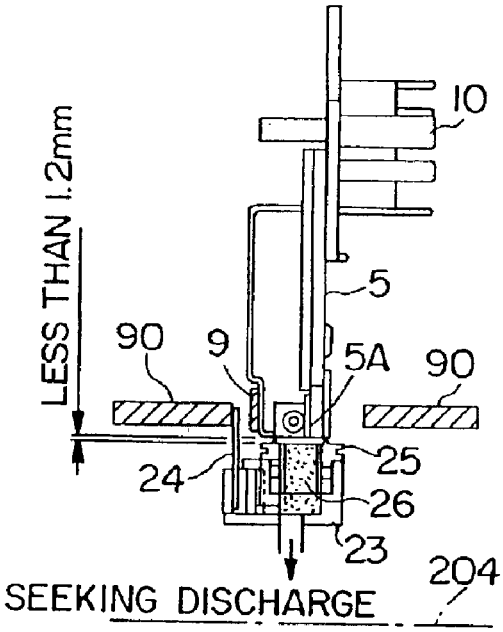
FIG. 9A to FIG. 9D are illustrative views which explain the positional relationship between the ink jet head and a trough portion, respectively.

FIG. 9A shows the capping position which is used at the time of capping with the head not put in practical use, at the time of pressurized recirculation to be described later, and at the time of preliminary ejection. At the capping position, an ink ejection port forming surface 5A of the head 5 and an absorbing member 26 closely face to each other with a predetermined gap therebetween. Incidentally, it has been confirmed that the head 5 exhibits excellent wiping properties when the foregoing gap is set to about 1.2 mm.

Figure 9B:
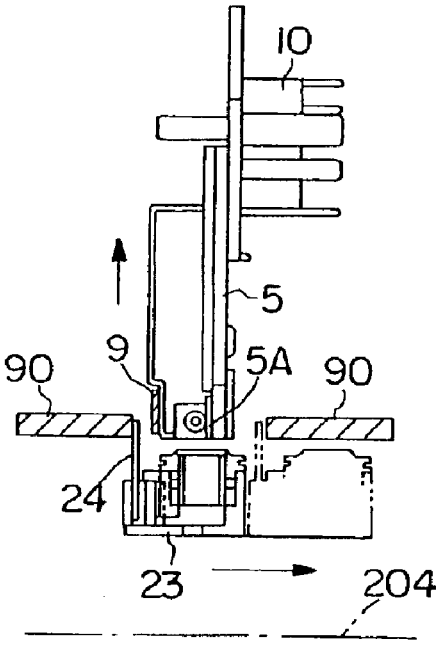

Next, FIG. 9B shows the state that the head 5 is located such that the upper part of the blade 24 is raised up by a predetermined distance above the ink ejection port forming surface 5A so that the ink ejection port forming surface 5A is wiped with the blade 24 by displacing the trough 23 from the position represented by solid in lines to the position represented by phantom lines.

Figure 9C:
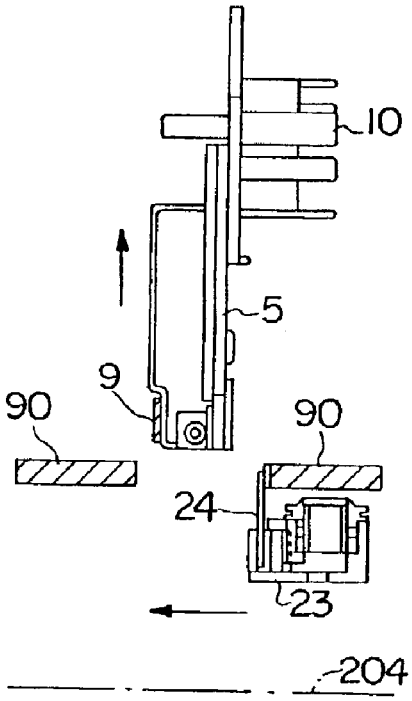
Figure 9D:
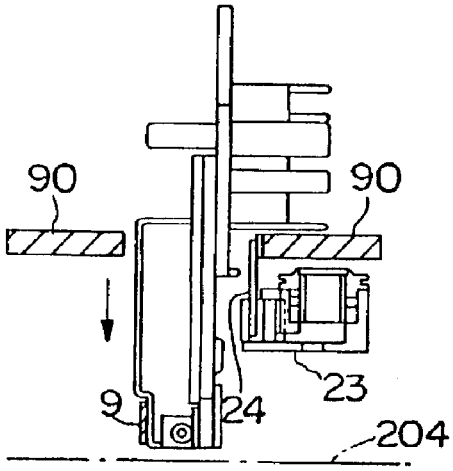

FIG. 9C shows the state that after completion of the wiping operation, the head 5 is retracted without any contact of the blade 24 with the head 5 when the trough 2 is displaced to the position where it faces to the head 5 in order to conduct preliminary ejection, and FIG. 9D shows the state that the head 5 is displaced in the downward direction in excess of the position shown in FIG. 9A and FIG. 9B to reach the position where it faces to the unrolled paper 204 to perform a printing operation.

In the drawings, reference numeral 90 denotes an absorbing member which is disposed between adjacent heads 5. The absorbing member 90 can collide against the opposite surfaces of the blade 24 so as to clean the blade 24. The absorbing member 90 is shown such that is immovably held. Alternatively, it may be raised and lowered together with the head 5.

Figure 10:
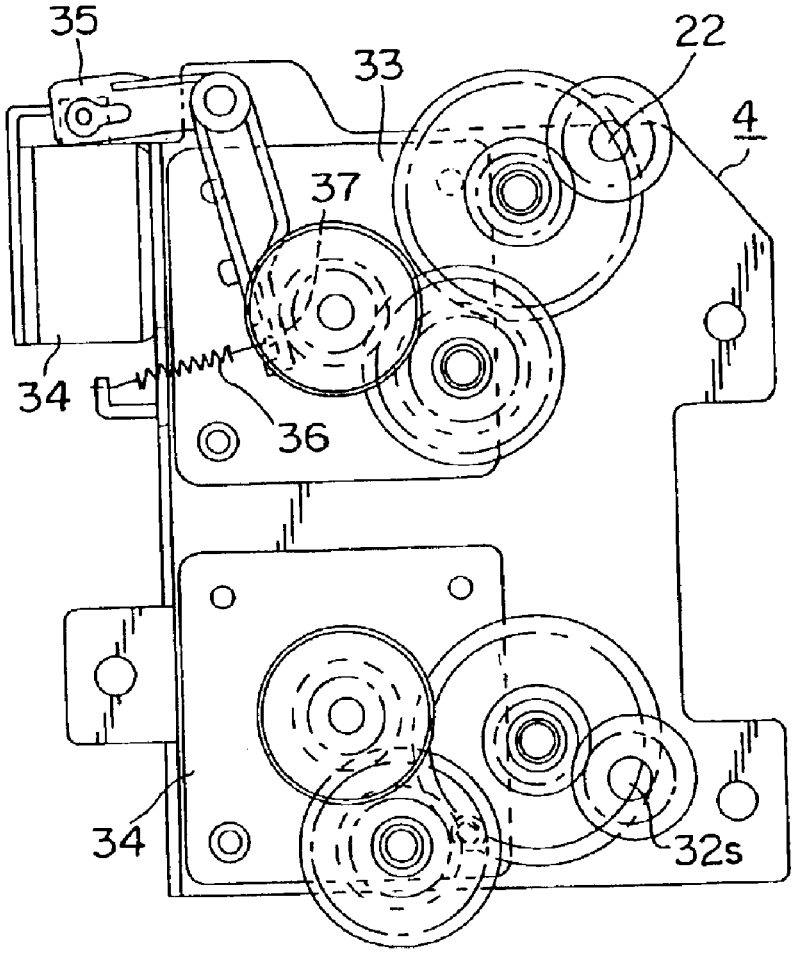
FIG. 10 is an illustrative view of a driving system unit.

FIG. 10 is an illustrative view which shows by way of example the structure of 2 driving system unit 4 or displacing each head in the upward/downward direction, and moreover, displacing recovering means in the horizontal direction.

This driving system unit 4 is arranged on the rear surface of the PHS holder 18 and includes two stepping motors 33 and 34 which displace the head holder unit 2 and the recovering system unit 3 by driving shafts 22 and 32*s* via a train of speed reduction gears. Incidentally, it is sufficient that head holder unit 2 and the recovering system unit 3 conduct relative displacement in the upward/downward direction as well as in the leftward/rightward direction. Alternatively, modification may be made such that, e.g., the recovering system unit 3 is immovably held and only the head holder side can be displaced.

The stepping motor 33 for raising and lowering the heads includes a mechanism for preventing the heads from falling down due to the dead weight of each head when the power source is turned on. This mechanism is carried of a one-way solenoid 34, a ratchet arm 35, a spring 36 and a ratchet gear 37. When the power source is turned off, electricity is fed to the solenoid 34 so that the ratchet arm 35 is brought in locking engagement with the ratchet gear 37 so as to prevent heads from falling down. On the contrary, when the power source is turned on, the ratchet arm 35 is disengaged from the locking engagement.

Figure 11:
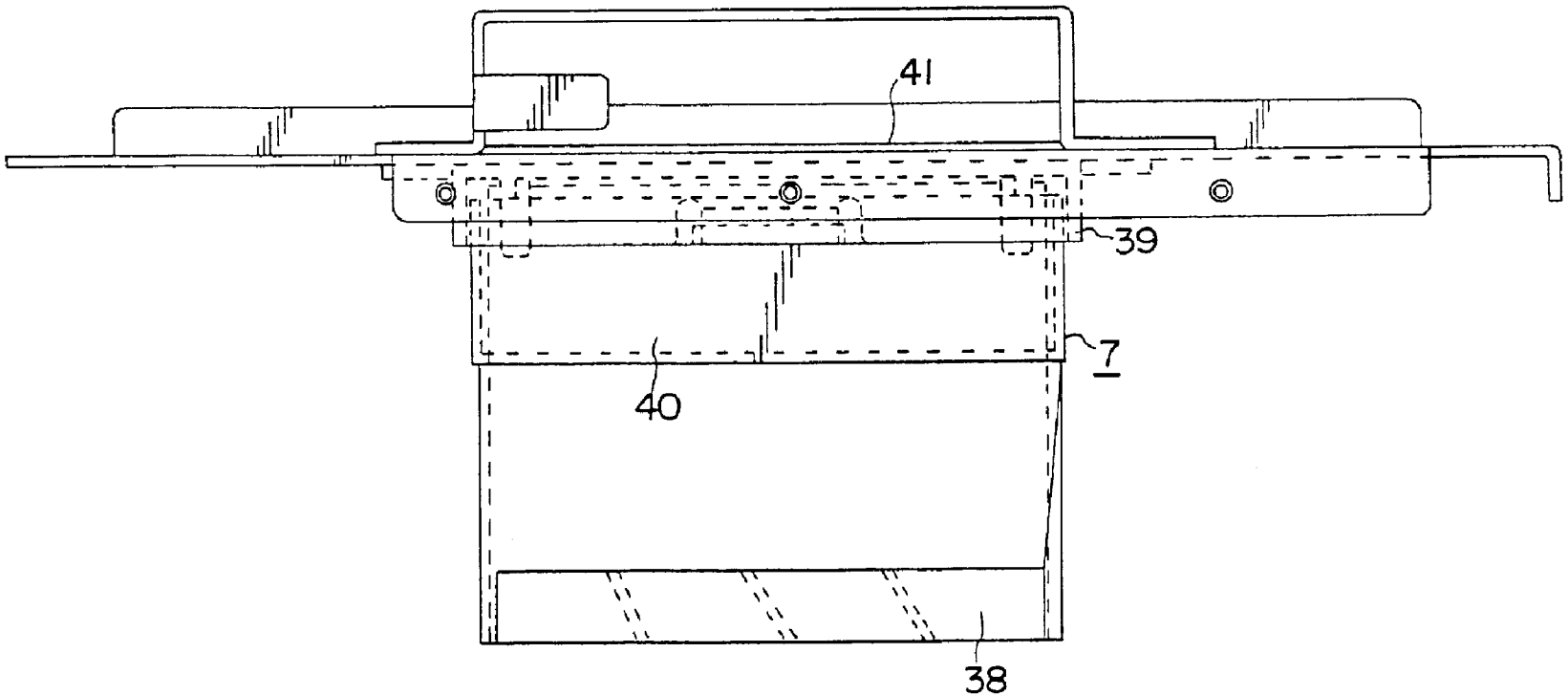
FIG. 11 is a plan view of a cooling unit.

FIG. 11 is a plan view which shows by way of example the structure of a cooling unit 7.

This cooling unit 7 is arranged on the rear surface of the PHS holder 18 and includes as essential components a fan 40 serving as an air blowing source, a duct 38 for blowing cooling air toward a heat radiating fin 10, a mounting platform 39, and a dust-proof filter 41 as essential components. Air is taken in the cooling unit 7 through the filter 41, and the intake air is blown toward the heat radiating fin 10 in order to cool the heads 5, as desired.

(3) Printing Medium Conveying Mechanism

Figure 12:
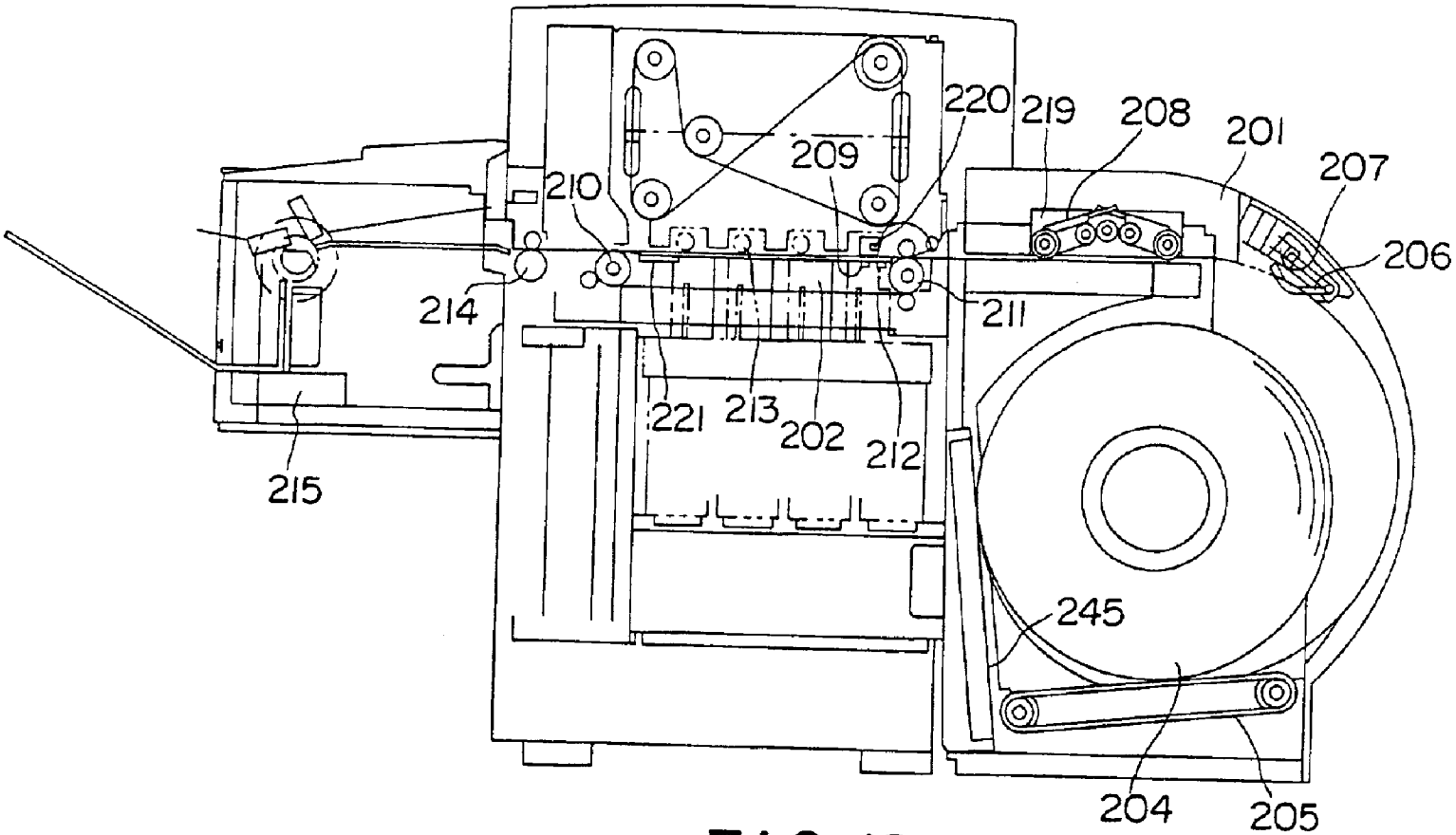
FIG. 12 is an explanatory view of the whole conveying system.
Figure 13:
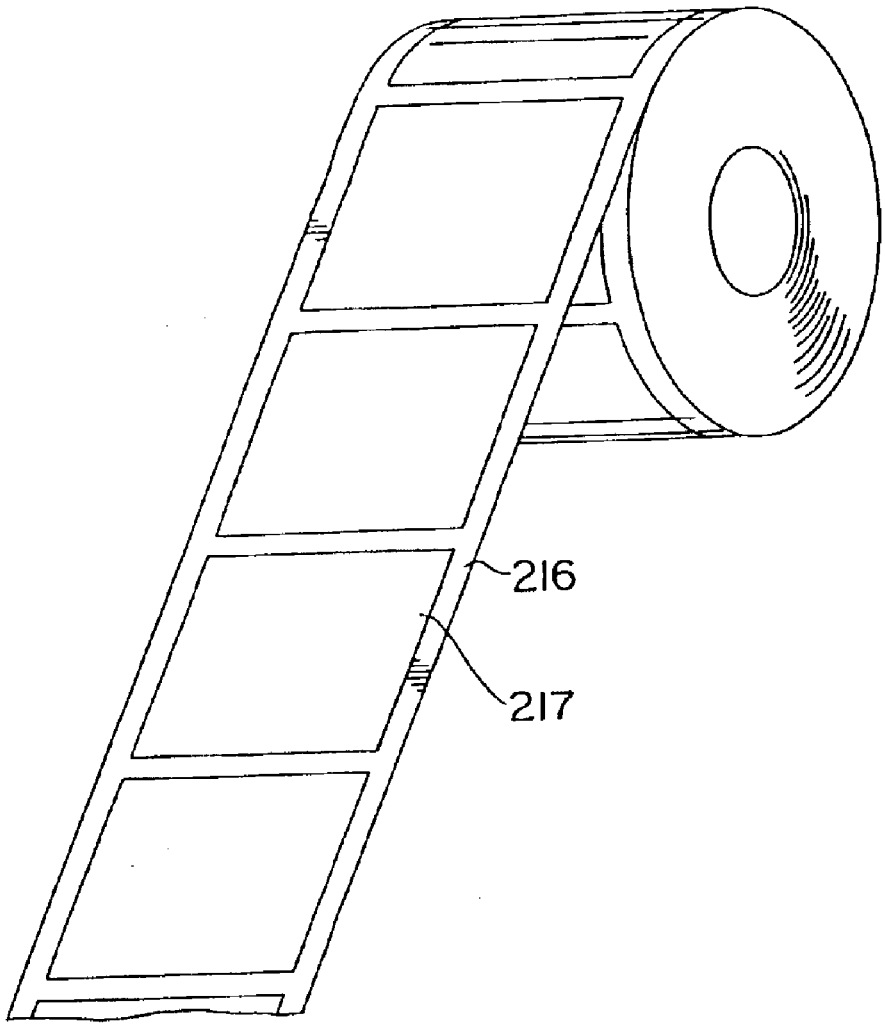
FIG. 13 is a perspective view of roll-shaped paper, showing by way of example a printing medium available for the label printer.

FIG. 12 and FIG. 13 are explanatory views which show a conveying system for a printing medium. FIG. 12 is a schematic side view which shows the whole conveying system and FIG. 13 is a perspective view which shows by way of example a paper roll available as a printing medium usable for the label printer.

In this embodiment, the conveying system is substantially composed of three elements, i.e., a roll feeding unit 201 for feeding a printing paper portion by unrolling a paper roll 204, a conveying unit 202 for practically conveying the unrolled printing paper on the housing side, and a cutter unit 215 for cutting the printed paper to have a predetermined length. In the shown case, these units are made integral with each other. Alternatively, they may be separated from each other. For example, a cut sheet feeding unit may be substituted for the toll feeding unit 201, and a printed paper winding unit may be substituted for the cutter unit 215.

(3.1) Roll Feeding Unit

FIG. 13 is a perspective view which shows by way of example the structure of a paper roll 204. This roll-shaped paper 204 is one of printing mediums which can be used for the label printer, and it is usually called label paper. A various kind of size is used for a label 217 depending on a utilization field of the latter. In this embodiment, a label 217 having a maximum width of 4 inch or less can be used for the label printer. A series of labels 217 are adhesively placed on peeling paper or ground paper that is called a separator 216 in the equally spaced relationship.

In addition to the label paper shown in FIG. 13, a printing medium itself wound in the form of a roll can be used as roll-shaped paper.

The roll feeding unit 201 serves to feed the roll-shaped paper 204 to he conveying unit 202 to be described later. As shown in FIG. 12, the roll feeding unit comprises a housing having a space in which the roll 204 is received, the roll 204 is placed on a conveying belt 205 which is disposed below the space in the roll feeding unit 201, and in response to a command instructing a printing standby state, the outer periphery of the roll 204 is rotationally driven as the conveying belt is actuated.

When the paper roll is unrolled by driving the outer periphery thereof like in the above-described manner for the purpose of paper feeding has the following advantages in comparison with the case that a paper roll is rotatably supported on a center drive shaft for the same purpose. Specifically, one of them is that setting of the paper roll to a paper feeding portion is completed merely by placing the roll on the conveying belt 205, other one is that a power transmission mechanism such as a train of speed reduction gears or the like required in the case of driving of the center shaft can be omitted or remarkably simplified, and another one is that it becomes possible to feed paper by a constant quantity at constant speed driving irrespective of a diameter of the paper roll as it is unrolled.

In this embodiment, as shown in FIG. 12, the conveying surface of the conveying belt 205 is inclined so as to allow the roll to be liable of being displaced in a predetermined direction, and moreover, the roll is caused to rest against a side plate 245. With this construction, a loop of paper caused by the loosened state on the unrolled side can easily be formed to some large extent.

Thus, the foremost end of the unrolled paper passes by a loop sensor 207, and subsequently, the unrolled paper is delivered to the paper conveying unit 202 via a slantwise conveying unit 208.

Next, the loop sensor 207 and the slantwise conveying unit 208 will be described below.

The loop sensor 207 is used to produce a loosened state of the printing medium in the form of a loop between the roll-shaped paper and the conveying unit 202, and moreover, it is controlled such that the printing medium is conveyed by the conveying unit 202 with a constant intensity of tension but without any influence caused by the back-tension from the roll-shaped paper. In this embodiment, the loop sensor 207 is prepared in the form of a photosensor which comes in contact with he loon of the unrolled paper 204 and of which optical axis is turned on or off by a loop plate 206 serving as an actuator adapted to be displaced as the loop disappears. Any type of loop sensor may be employed, provided that it is proven that it can detect the presence or the absence of a loop. The loop sensor is typically exemplified by an electrical contact switch and an electrostatic capacity switch for detecting a distance between the loop plate and the switch itself.

Figure 14:
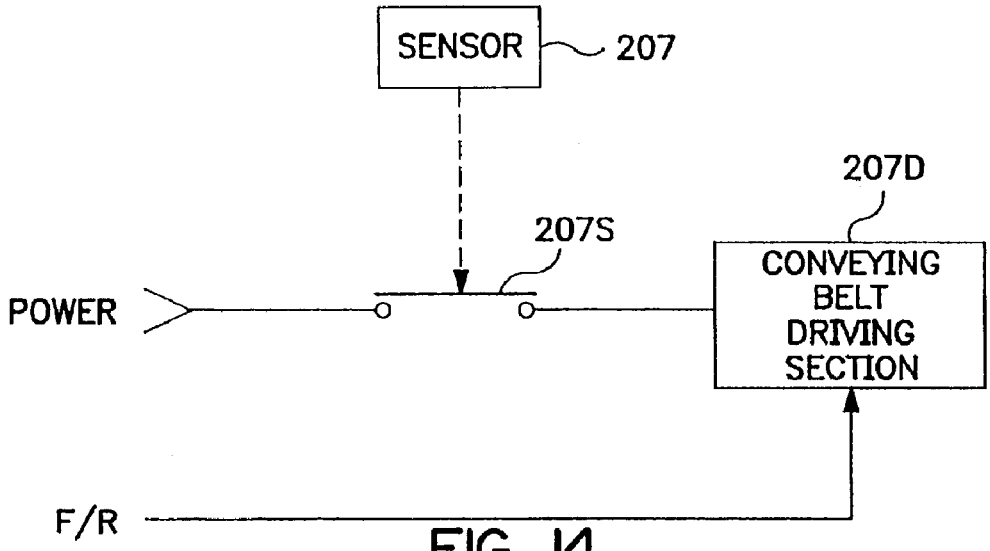
FIG. 14 is a circuit diagram which shows by way of example the structure of a driving and controlling system for a conveying belt.

FIG. 14 is a circuit diagram which shows by way of example the structure of a driving and controlling system for the conveying belt 205 which is driven and controlled in response to an output from the loop sensor 207. In the figure, reference numeral 207D denotes a driving portion such as a motor or the like for driving the conveying belt 205, and reference numeral 207S denotes a switch which disposed on a power supply line extending from the housing of the label printer. The switch 207S serves to shut the power supply line in response to an output from the sensor 207 (in the case that a predetermined quantity of loop is formed) but keep the power supply line in the closed state when no output is generated from the sensor 207 (in the case that the loop can not be detected).

Reference character F/R denotes a signal which is sent from the main housing of the label printer for determining that the conveyer belt is actuated in the normal direction (i.e., in the unwinding direction of the roll-shaped paper) or determining that the conveying belt is actuated in the reverse direction (i.e., in the winding direction of the unrolled paper). This signal F/R is generated if necessary. In this embodiment, the label printer is constructed such that the unrolled paper can be fed back by the conveying unit 202 in the main housing as will be described later. In the case that there is a possibility that an undesirable quantity of loop is formed in the roll feeding unit 201 due to reverse feeding of the unrolled paper, it is sufficient that the conveying belt is reversely driven corresponding to the reverse feeding of the unwound paper. In this case, an electricity supplying operation is shifted to ON or OFF in response to OFF or ON of the sensor 207, and subsequently, reverse driving can be stopped when no loop is detected by the sensor 207.

The slantwise feeding unit 208, disposed upper the space in which the roll is received, has functions that the unrolled paper 204 is brought in the paper feeding unit 202 from a predetermined position and that paper conveying is carried out in such a manner that the unrolled paper 204 is caused to collide against a reference guide 219 located at the foremost end of the slantwise feeding unit 208 in the direction of an axis of the roll.

In this embodiment, unrolled paper conveyance is shifted to ON or OFF in response to OFF or ON of the sensor 207. Provided that the sensor 207 is constructed in such a manner as to enable the variation of a quantity of loop to be detected, the conveyance belt 205 may be driven at all times. Otherwise, a quantity of driving (i.e., a quantity of feeding of the unrolled paper) may be controlled corresponding to the variation of a quantity of loop. At any rate, feeding of the unrolled paper to the roll feeding unit 201 can be carried out highly independently of the conveyance of the unrolled paper in the conveying unit 202 in the main housing of the label printer. Thus, connection of signals between both the units 201 and 202 can be simplified, and moreover, a magnitude of load to be borne by a controlling section in the main housing of the label printer can be reduced. These facts are advantageous for making it possible to separate the roll feeding unit 201 from another one.

A plurality of sensors may be disposed for assuring that respective components constituting the roll feeding unit 201 are stopped after the roll-shaped paper is completely unrolled and that this fact is instructed to the main housing of the label printer. In view of the fact that the fore end part of the unrolled paper is suspended from the slantwise conveying unit 208 on completion of the unwinding operation, a sensor system available for the foregoing fact may be composed of an actuator adapted to be displaced on contact with the suspended part of the unrolled paper and a sensor adapted to be turned on or off depending on a magnitude of displacement of the actuator.

In the embodiment discussed above, the roll feeding unit feeds the unrolled paper by rolling the paper roll with the conveying belt which is in contact with the periphery of the paper roll. However, it should be noted that embodiments applied for the present invention are not limited to the above. It may be possible to use a roller or a plurality of rollers being contact with the periphery of the roll 204 so that the roll 204 is driven by the roller or rollers form the periphery of the roll. In the case that a plurality of rollers are used, it may be sufficient to drive least one roller.

(3.2) Conveying Unit

The conveying unit 202 is located below the printing head station and includes a conveying roller 210 to be driven by a driving system (riot shown), a follower roller 211, a conveying belt 212, and a paper discharging roller 214 as essential components.

As the unrolled paper 204 is fed from the roller feeding unit 201, it is fed further by the conveying unit 202 at a predetermined speed. With the label printer constructed in the above-described manner, the foremost end of each label is detected as a trigger for starting a printing operation, and for this purpose, a TOF (Top of Form) mark is preliminarily printed on the rear side of the unwound paper 204. To detect each TOF mark, a TOF sensor 209 is disposed at the rear end part of the conveying unit 202. Thus, a size of each label can be detected based on the gap between adjacent TOF marks on the assumption that the foregoing gap is kept constant, and moreover, the range available for each printing operation can be detected.

In this embodiment, each TOF mark can be detected using a reflective type sensor 209, and moreover, it is possible to detect the position where each printing operation is started and the size of each label using a separator having high light permeability and a light permeable type sensor. In addition, a label presence/absence sensor 220 is disposed rightward of the TOF sensor 209 to detect whether a label paper is present or absent, whereby no printing operation is performed when any label paper is not present. A jam detecting sensor 221 is disposed on the downstream side so that a malfunction of paper jamming can be detected by the jam detecting sensor 221 in cooperation with the TOF sensor 209.

(3.3) Cutter Unit

A cutter unit 215 is one of units arranged on the discharge side of the paper conveying unit 202 and has a role for cutting the unwound paper 204 to have a predetermined length.

The cutter unit 215 is composed of one set of stationary blade and rotary blade, and a timing for cutting the unwound paper 204 is determined in operative association with a conveying speed of the paper conveying unit 202 and detection of each TOF mark.

After a final printed label paper is cut, the paper conveying unit 202 and the conveying belt 205 are reversely operated so that the unrolled paper 204 is returned to a printing standby position.

In the case that a unit for continuously winding a band of paper is substituted for the clatter unit 215, the same loop as mentioned above can be formed so as not to allow the conveyance in the conveying unit 202 to be adversely affected by the winding operation.

For example, such a winding unit (printing medium winding unit) as mentioned above can be constructed such that another feeding unit 201 as shown in FIG. 12 is arranged in the symmetrical relationship relative to the conveying unit 202, a controlling system as shown in FIG. 14 is arranged, the same conveying belt as the conveying belt 205 is driven when an occurrence of predetermined loosening (loop) is detected, and driving of the foregoing conveying belt is stopped when appearance of the loop is not detected. With respect to a conveying belt for placing a wound roll-shaped printing medium thereon, a measure may be taken such that the roll portion of the printing medium conveyed from the conveying unit 202 side rests against a side wall by utilizing a tendency of causing the printing medium to move in the opposite direction to the advancing side to the roll portion, whereby a loop can easily be enlarged. Incidentally, the fore end part of the printing medium may be wound about a spool or the like which in turn is placed on the conveying belt to enable an initial winding operation to be smoothly performed.

(3.4) Other Embodiment of the Roll Feeding Unit

Figure 35:
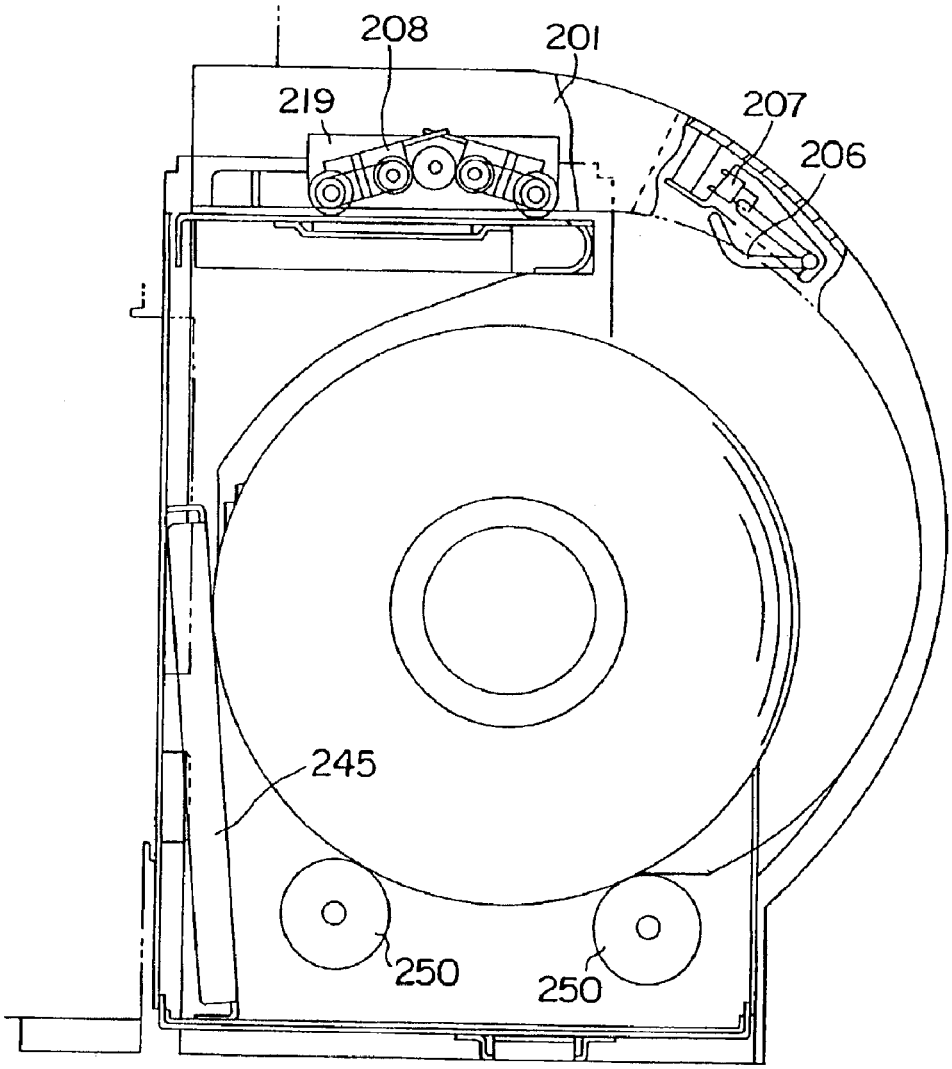
FIG. 35 is a side view of a roll feeding unit, showing that two rollers each molded of a resin are used for unwinding a roll-shaped paper.

In the first embodiment as mentioned above, the roll feeding unit is exemplified by the conveying belt for unrolling the roll-shaped paper by driving the outer periphery of the latter. It is appreciable as a second embodiment that the roll feeding unit is provided two conveying rollers 250 as shown in FIG. 35. In this case, it is desirable that each roller is molded of a synthetic resin having a small frictional coefficient relative to the roll-shaped paper. With this construction, an adequate intensity of tension can easily be maintained because when an intensity of tension in excess of a necessary level is applied to the roll-shaped paper, slippage takes place between the roll-shaped paper and the two rollers (refer to a paragraph "Precedent treatment for a blank paper and subsequent treatment for the blank paper" to be described later).

The same structure as mentioned above can be employed for a winding unit.

(4) Ink System

Figure 15:
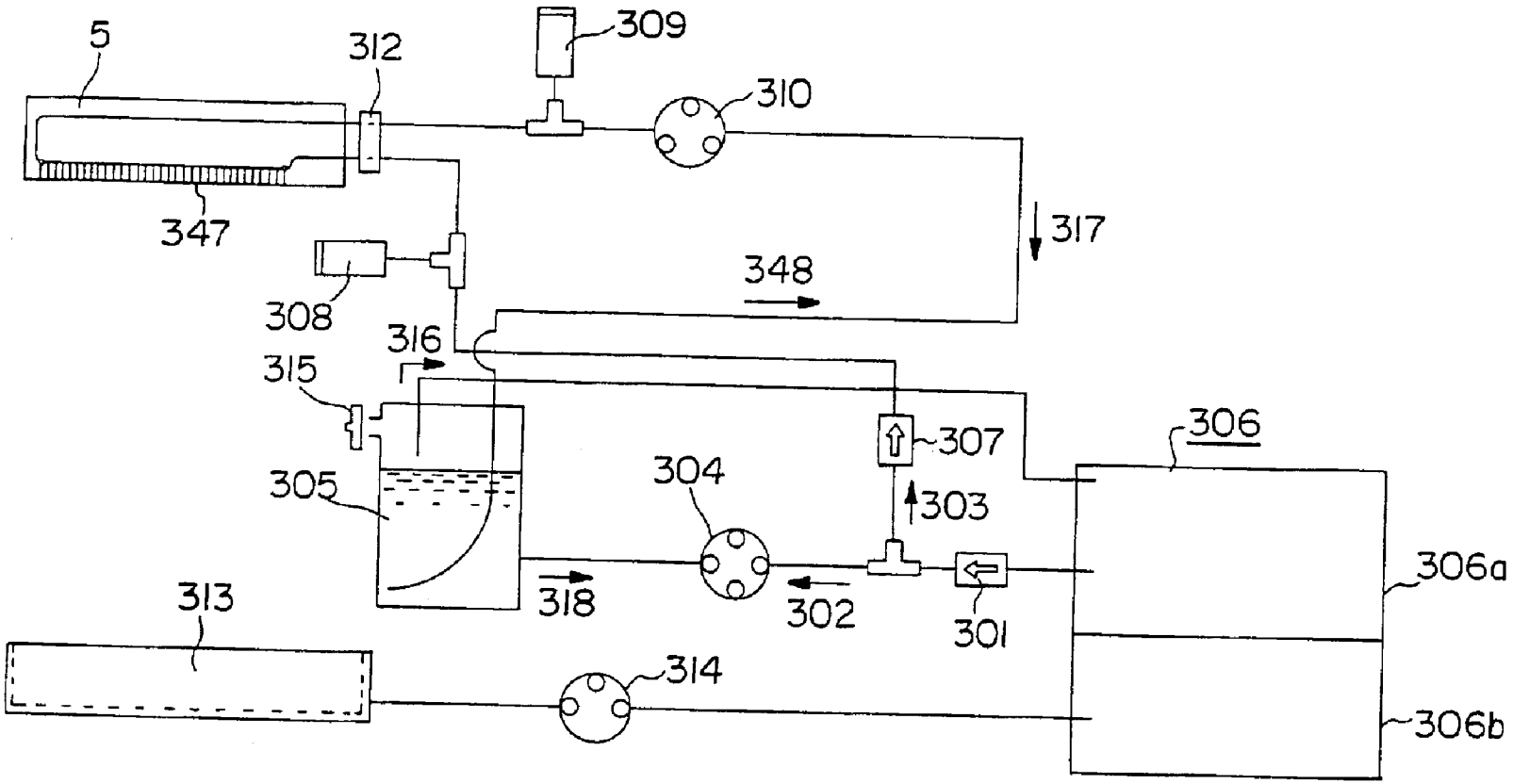
FIG. 15 is a block diagram which shows the whole structure of an ink feeding system.

FIG. 15 is a block diagram which shows the whole structure of an ink feeding system for the label printer. The whole system will be described below in conformity with the order of flowing of ink.

As a pressurizing pump 304 is rotated in the counterclockwise direction (at this time, a motor 343 is rotated in the clockwise direction), ink in an ink receiving portion 306*a* of a cartridge 306 flows in the direction represented by arrow 302 via a one-way valve 301 so that it is storably received in a subtank 305. When a predetermined quantity of ink is stored in the subtank 305 as ink is increasingly received in the same, ink flows in the direction as represented by arrow 316 to return to the cartridge 306 again. At this time, an opening/closing mechanism 315 for the subtank 305 is kept closed.

Next, when the pressurizing pump 304 and a suction pump 310 are rotated in the clockwise direction (at this time, the motor 343 is rotated in the counterclockwise direction), ink stored in the subtank 305 flows in the directions as represented by an arrow mark 318 and an arrow mark 303 and then flows toward a head 5 via a one-way valve 307, and an air buffer 308 and a joint 312. After ink recirculates in the head 5, it flows in the direction represented by an arrow mark 317 via a joint 312 and an air buffer 309 to return to the subtank 305 again. At this time, the opening/closing mechanism 315 for the subtank 305 is kept opened.

Figure 16:
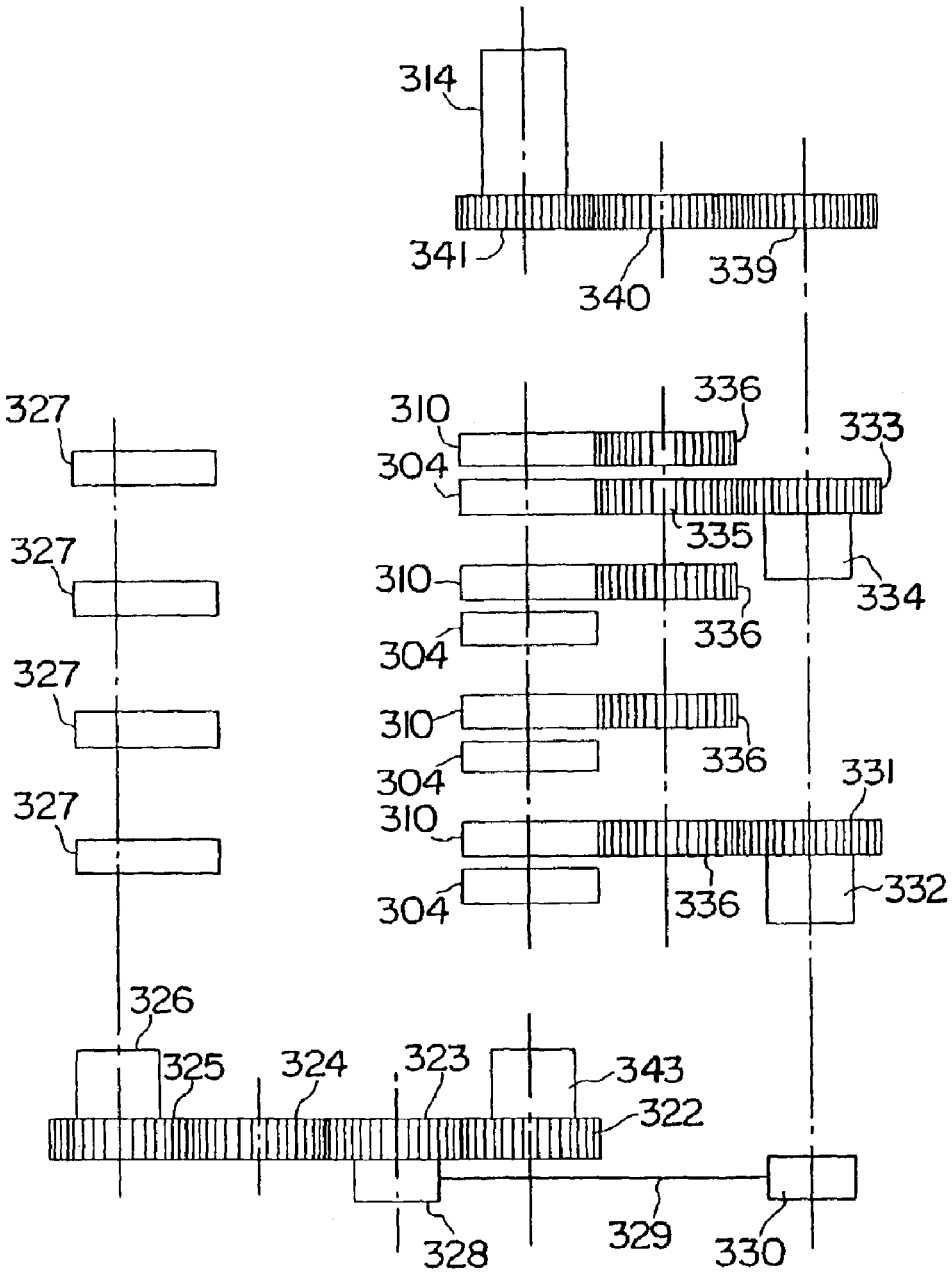
FIG. 16 is a block diagram which schematically shows a driving force transmitting system.
Figure 17:
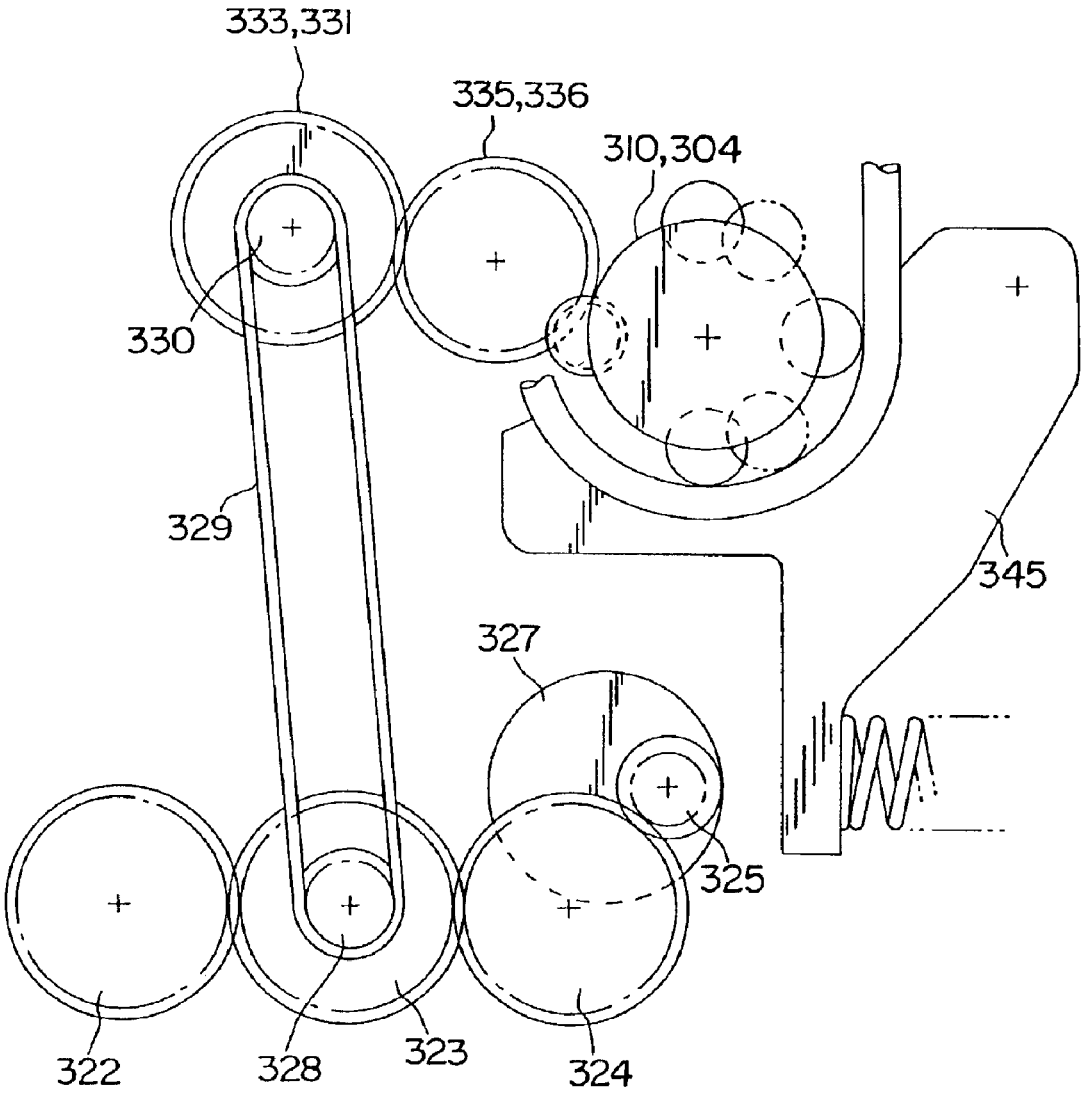
FIG. 17 is a fragmentary schematic view of the driving force transmitting system.

Next, FIG. 16 is a block diagram which shows a driving power transmission system, and FIG. 17 is a schematic view of the driving power transmission system. Description will be made below with respect to how a driving power is transmitted to respective pumps and cams from the motor 343.

The motor 343 includes a motor gear 322 which meshes with a gear 325 for a cam clutch 326 via gears 323 and 324. When the cam clutch 326 is shifted to ON, power is transmitted from the motor 343 to four cams 327 of which number is coincident with the number of heads. Next, the gear 323 is operatively associated with a pulley 328 which serves to transmit power to a pulley 330 via an endless belt 329. On the other hand, when a clutch 332 is shifted to ON, driving power is transmitted to suction pumps 310 from a gear 331 via idler gears 336. Since the idler gears 336 are fixedly mounted on a shaft, when one of four idler gears 336 is rotated, other three idler gears 336 are simultaneously rotated.

When a pressurizing pump clutch 334 is shifted to ON, a gear 333 serves to transmit driving force to pressurizing pumps 304 via an idler gear 335. Since pressurizing pumps 304 are fixedly mounted on a shaft, when one of four pressurizing pumps 304 is rotated, other three pressurizing pumps 304 are simultaneously rotated.

Only rotation of the motor 343 in one direction is transmitted to a recovering pump 314 via a gear 339, a gear 340 and a one-way gear 341.

Next, the stationary state and the operative state of each pump will be described below.

Figure 18B:
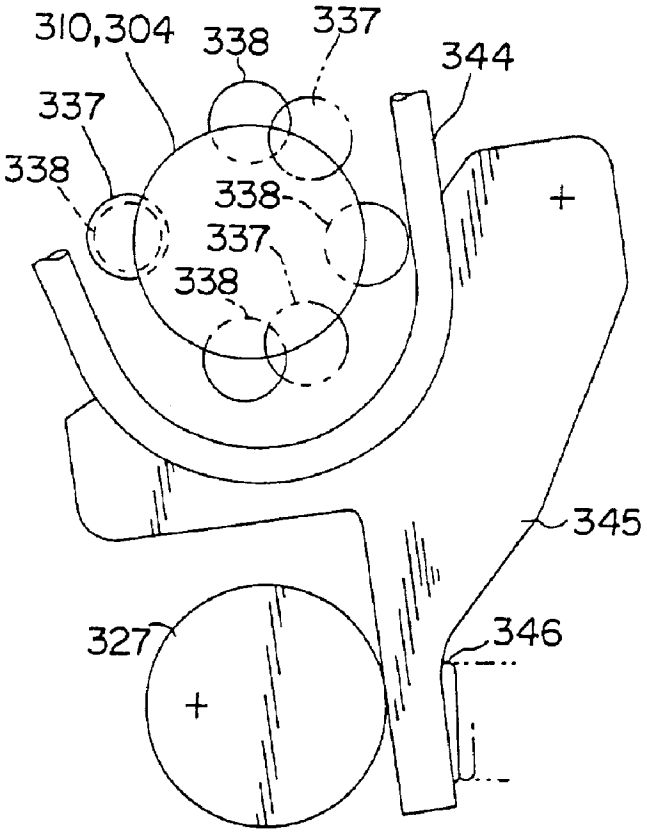
FIG. 18A and FIG. 18B are explanatory views of a pressurizing pump, showing that a tube is thrusted and that the tube is released from the thrusted state, respectively.
Figure 18A:
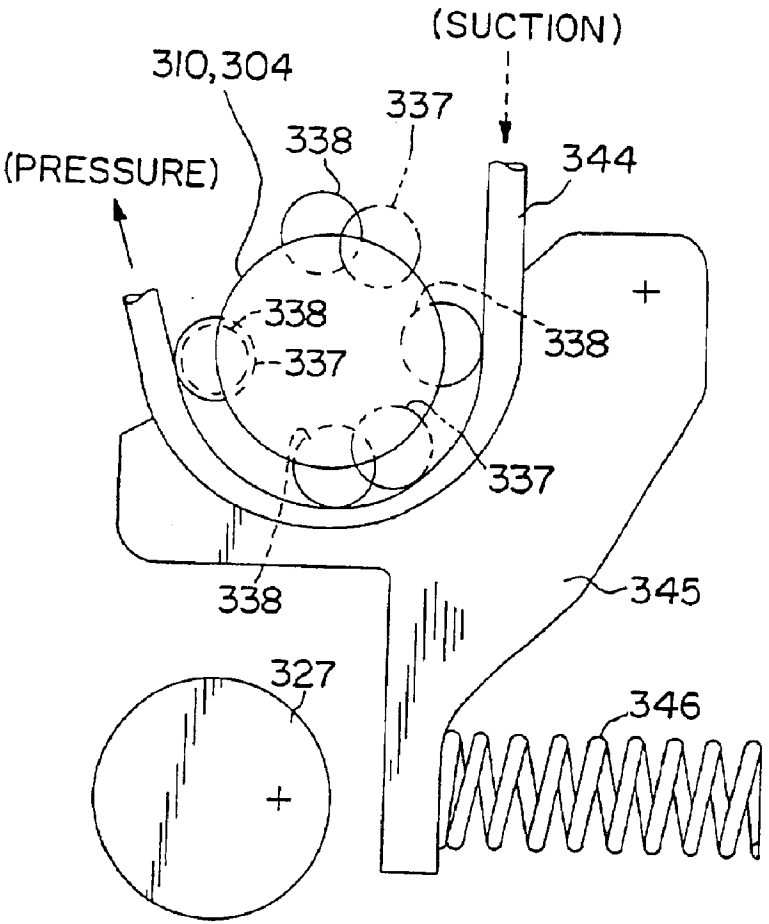

In the case that each pressurizing pump 304 and each suction pump 310 are held in the stationary state, an eccentric cam 327 raises up a pressuring/suction pump retainer 345, causing a tube 344 to be released from the thrusted state, as shown in FIG. 18B. In the case that at least one of each suction pump 304 and each suction pump 310 is driven, the eccentric cam 327 is rotated, and subsequently, the tube 344 as thrusted by the pressuring/suction tube in cooperation with a spring 346, whereby a pressurizing pump roller 338 or a suction pump roller 337 is rotated while thrusting the tube 344, as shown in FIG. 18A.

Figure 19A:
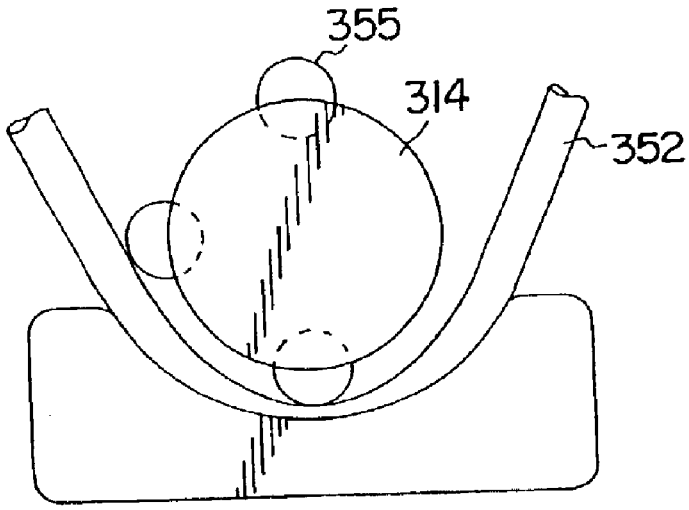
FIG. 19A and FIG. 19B are explanatory views of a recovering pump, showing that a tube is thrusted and that the tube is released from the thrusted state, respectively.
Figure 19B:
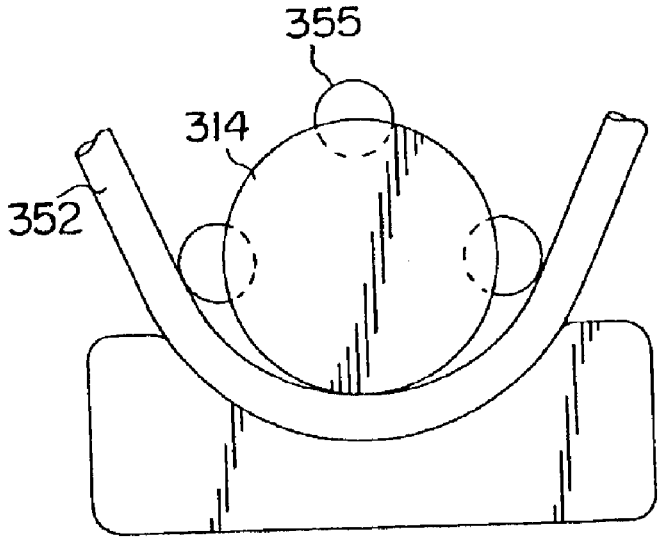

In the case that the recovering pump 314 is held in the stationary state, the tube 352 is released from the thrusted state because any recovering pump roller 355 is not placed on the tube 352 as shown in FIG. 19B. When the recovering pump 314 is driven, the recovering pump rollers 355 are rotated while thrusting the tube 352 therewith.

Feeding of Ink:

Next, a method of feeding ink from the cartridge 306 to the subtank 305 will be described below.

As the pressurizing pump 304 is rotated in the counterclockwise direction, ink in the ink receiving portion 306*a* of the cartridge 306 flows in the direction represented by arrow 302 via the one-way valve 301 so that it is stored in the subtank 305. At this time, no ink is sucked from the head 5 because of the presence of the one-way valve 307 but ink is sucked only from the ink receiving portion 306*a* of the cartridge 306. When ink is increasingly stored to reach a predetermined level in the subtank 305, it starts to flow in the direction represented by arrow 16 to return to the ink receiving portion 306*a* of the cartridge 306 again. At this time, since the opening/closing mechanism 315 on the subtank 305 is kept closed, the ink supplying system becomes a closed system. This makes it possible for ink to recirculate in the closed system.

Next, description will be made below with respect to transmission of the driving power required for supplying ink, with reference to FIG. 16. First, when the motor 343 in rotated in the clockwise direction while the tube 344 is released from the thrusted state (see FIG. 18B) and the cam clutch 326 is shifted to ON, the eccentric cam 327 is rotated, causing the tube 355 to be thrusted (see FIG. 18A) Subsequently, the cam clutch 326 is shifted to OFF, the opening/closing solenoid is turned on (to assume the closed state), and the pressurizing pump clutch 334 is shifted to ON. Thus, ink is fed to the subtank 305. Next, the pressuring pump clutch 334 is shifted to OFF, the opening/closing solenoid is turned off (to assume the opened state), the cam clutch 326 is shifted to ON, and the tube 344 is released from the thrusted state (see FIG. 18B). Then, the cam clutch 326 is shifted to OFF and rotation or the motor 343 is stopped, whereby treatment for feeding ink is completed.

Large-Scaled Recovering:

Next, a method of large-scaled recovering will be described below.

When the pressuring pump 304 is rotated in the clockwise direction, ink in the subtank 305 flows in the direction represented by arrow 318 and arrow 303 to reach the head 5 via the one-way valve 307, the air buffer 308 and the joint 312, whereby ink flows from a plurality of ink ejection ports 347. Subsequently, when the suction pump 310 is rotated in the clockwise direction while the pressurizing pump 304 is rotated, ink recirculates in the head and flows in the direction represented by arrow 317 via the joint 312 and the air buffer 309 to return to the subtank 305 again. Also at this time, ink flows from the ink ejection ports 347. Then, rotation of the suction pump 310 is stopped but only the pressurizing pump 310 is rotated, causing ink to flow from the ink ejection ports 347.

At this time, the opening/closing mechanism 315 on the subtank 305 is kept opened. Ink recirculates in the head 5 without flowing to the ink receiving portion 306*a* of the cartridge 306 because of the presence of the one-way valve 301. Owing to the arrangement of the air buffer 308 and the air buffer 309, ink can smoothly recirculate while suppressing the pulsation induced by the pressurizing pump 304 in cooperation with the suction pump 310.

Ink flown from the ink ejection ports 347 is received in a recovering system from which ink is stored in a waste ink portion 306*b* of the cartridge 306 by rotating a recovering pump 314.

Next, description will be made below with respect to transmission of driving force in the case of large-scaled recovering, with reference to FIG. 16. First, while the tube 344 is released from the thrusted state (see FIG. 18B), the cam clutch 326 is shifted to ON and the motor 343 is rotated in the clockwise direction, causing the tube 344 to be thrusted (see FIG. 18A). Then, the cam clutch 326 is shifted to OFF, rotation of the motor 343 is stopped, the pressuring pump clutch 334 is shifted to ON, and subsequently, the motor 343 is rotated in the counterclockwise direction.

Thus, the pressurizing pump 304 is rotated in the clockwise direction, and at the same time, the recovering pump 314 is rotated in the clockwise direction. Then, the suction pump clutch 332 is shifted to ON, and both of the pressurizing pump 304 and the suction pump 310 are simultaneously rotated in the clockwise direction. Next, when the suction pump clutch 332 is shifted to OFF, rotation of the suction pump 310 is stopped. After the pressurizing pump 310 continues to be rotated, the clutch 334 is shifted to OFF, causing actuation of the clutch 334 to be stopped. Next, rotation of the motor 343 is stopped, the clutch 326 is shifted to ON, and subsequently, the motor 343 is rotated in the clockwise direction, causing the tube 344 to be released from the thrusted state (see FIG. 18B) Then, the clutch 326 is shifted to OFF and rotation of the motor 343 is stopped. At this time, rotation of the recovering pump 314 is stopped to assume the state shown in FIG. 19A, whereby treatment for feeding ink is completed.

Printing:

When a printing operation is performed, supplementing of ink to the head 5 is executed from the subtank 305. As shown in FIG. 18B, since the tube 344 is released from the thrusted state, ink can be supplemented to the head 5 from the direction represented by arrow 318 and arrow 303, and additionally, ink can be supplemented to the head 5 from the direction represented by arrow 348. At this time, the opening/closing mechanism 315 on the subtank 305 is kept opened.

Any clutch and any pump are not driven during each printing operation, and supplementing of ink is effected only by a refilling operation caused by ink ejection.

Exchanging of the Head with Another One:

Next, description will be made below with respect to exchanging of the head with another one.

In the case that a new head having particular ink filled therein is mounted on the label printer, all the ink of foregoing type should be exchanged with the present ink filled in the subtank 305. Here, a method of exchanging the former with the latter will be described below.

First, the pressurizing pump 304 is rotated in the clockwise direction so that ink in the subtank 305 is caused to flow in the directions represented by arrow 318 and arrow 303 so as to allow ink filled in the ink ejection ports 347 to be discharged therefrom. Next, rotation of the pressurizing pump 304 is stopped, and the suction pump 310 is rotated in the counterclockwise direction, whereby the ink in the subtank 305 is caused to flow in the direction represented by arrow 348 so as to allow ink to be likewise discharged from the ink ejection ports 347. Then, rotation of the suction pump 310 is stopped, and the pressurizing pump 304 is rotated in the clockwise direction so as to allow ink to be discharged from the ink ejection ports 347. The aforementioned operations are repeated several times. Thereafter, exchanging of the head with another one is completed by conducting the large-scaled recovering as mentioned above.

Subsequently, the procedure of transmitting driving force during exchanging of the head with another one will be described below. First, while the tube 344 is released from the thrusted state (see FIG. 18B), the cam clutch 326 is shifted to ON, and the motor 343 is rotated in the clockwise direction, causing the tube 344 to be thrusted (see FIG. 18A). Then, the cam clutch 326 is shifted to OFF, and rotation of the motor 343 is stopped.

Next, the motor 343 is rotated in the counterclockwise direction, the pressurizing clutch is shifted to ON, and the pressurizing pump 304 is rotated in the clockwise direction. After several seconds elapse, the pressurizing pump clutch 343 is shifted to OFF, and rotation of the motor 343 is stopped. Subsequently, the motor 343 is rotated in the clockwise direction. The suction pump clutch 332 is shifted to ON, and the suction pump 310 is rotated in the counterclockwise direction. After several seconds elapse, the suction pump clutch 332 is shifted to OFF, and rotation of a the motor 343 is stopped.

After rotation and stoppage of the pressurizing pump 304 and the suction pump 310 are repeated several times as mentioned above, the aforementioned large-scaled recovering is conducted so that exchanging of the head with another one is completed.

Middle-Scaled Recovering:

When the pressurizing pump 304 is rotated in the clockwise direction, ink flows from the subtank 305 in the direction represented by arrows 318 and 303, causing ink to be discharged from the ink ejection ports 347 of the head 5 to be discharged. Ink discharged from the ink ejection ports 347 is received in the ink recovering system 313 so that it is stored in the waste ink portion 306*b* of the cartridge 306 by rotating the recovering pump 314.

The procedure of transmitting driving power for conducting the middle-scaled recovering will be described below. First, while the tube 344 is released from the thrusted state (see FIG. 18B), the cam clutch 326 is shifted to ON, and the motor 343 is rotated in the clockwise direction, causing the tube 344 to be thrusted (see FIG. 18A). Next, the pressuring pump clutch 334 is shifted to ON, and the motor 343 is rotated in the counterclockwise direction. Thus, the pressurizing pump 301 is rotated in the clockwise direction, and the recovering pump 314 is likewise rotated in the clockwise direction. Then, the pressurizing pump clutch 334 is shifted to OFF, and rotation of the motor 343 is stopped. Next, the cam clutch 326 is shifted to ON, and the motor 343 is rotated in the counterclockwise direction, causing the tube 344 to be released from the thrusted state (see FIG. 18B).

Subsequently, after the clutch 326 is shifted to OFF, rotation of the motor 343 is stopped to assume the position shown in FIG. 19A.

(5) Hardware for a Controlling System

Figure 20:
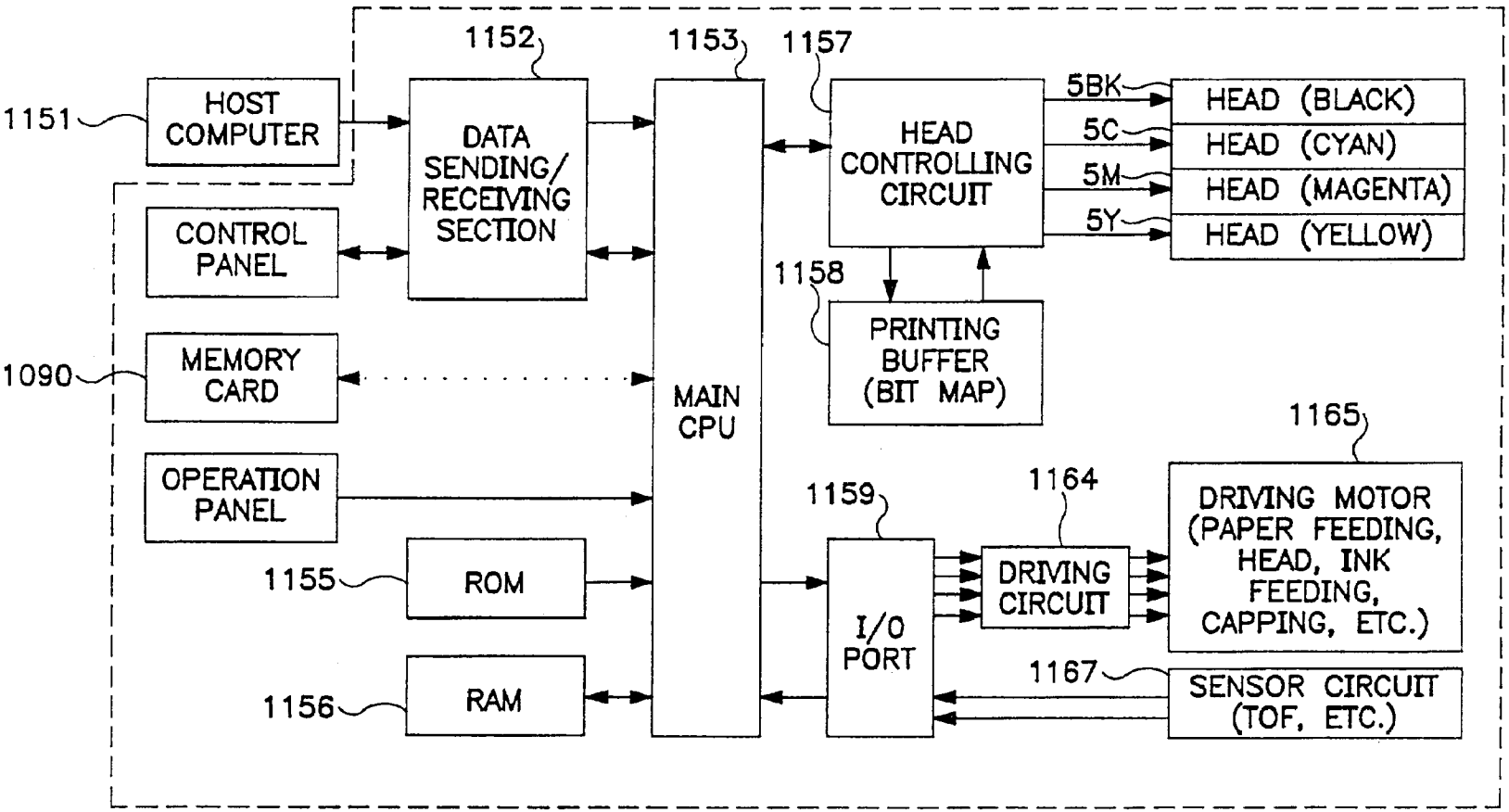
FIG. 20 is a block diagram which shows by way of example the whole structure of a controlling system.

FIG. 20 is a block diagram which shows by way of example the whole structure of a controlling system constructed in accordance with this embodiment. In this controlling system, after image data to be printed by the label printer are prepared or edited in a host computer 1151, they are delivered to a data sending/receiving section 1152 as color image data or color character data.

In this connection, there arises an occasion that the image data are received as bit map data for each of four colors (black, cyan, magenta and yellow plus particular color as desired), and there arises another occasion that they are received as character code data for the same. Whether received printing data are bit map data or character code data is discriminated depending on the preliminarily received command. In the case that the received printing data are character code data, commands such as printing operation start position designation, a character font, a character size and character color designation are inserted into the received printing data every character data or every row of a plurality of characters.

The data received by the data sending/receiving section 1152 are read by a main CPU 1153, and subsequently, they are memorized in a working range arranged in a RAM 1156. Since they are developed in the form of a bit map with a character as a unit, the content of a character generator corresponding to the relevant character is read from ROM 1156, and the results derived from reading are written in a printing buffer 1158. The printing buffer 1158 independently holds data for one page (one label) for each of four colors, i.e., black, cyan, magenta and yellow corresponding heads 5Bk to 5Y. In this embodiment, a line head having 1,344 ink ejecting ports arranged per single head in the transverse direction is used with printing resolution of 360 dpi (dots per inch), and each printing operation is performed with 1,328 ink ejection nozzles among 1,344 ink ejection nozzles with eight ink ejection ports located at the opposite ends of the line head removed therefrom. In other words, printing data are prepared for 1,328 dots, and when they are developed to the printing buffers 1158, blank data corresponding to eight dots at the opposite ends of the line head are added to 1,328 dots, whereby the printing data are prepared in the form of data corresponding to 1,344 dots. 1,344 ink ejection ports are divided into 21 blocks each composed of 64 ink ejection ports which in turn are driven in a head controlling circuit 1157.

A controlling program inclusive of a recovering treatment program to be described later is stored in ROM 1155 for controlling the whole color printer together with a character generator and a bar code generator. While the color printer is controlled in conformity with the controlling program, CPU 1153 controllably drives driving motors 1165 via I/O port 1159 and driving circuit 1164. The driving motors 1165 include a motor for conveying printing papers, a motor for displacing he head in the upward/downward direction, and a motor for activating recovering system units.

A sensor circuit 1167 includes home position sensors for determining reference positions for a TOF sensor for detecting a head position of each label for achieving each printing operation, a head motor and a capping motor, an ink level sensor for monitoring a quantity of each remaining colored ink and other sensors.

The main CPU 1153 has an occasion that printing data received from the host computer 1151 are stored in a memory card 1090. In the case that each printing operation is performed with the label printer separated from the host computer 1152, the data stored in the memory card 1090 are usually prepared in the form of character code data. However, there arises an occasion that the printing image data held in the stationary state without any necessity for changing the data are stored as bit map data corresponding to four colors.

(6) Precedent Treatment for Blank Paper and Subsequent Treatment for Blank Paper:

According to the present invention, since a full line type head is used for the label printer, there is not present "line" as appears with a serial printer. For this reason, a recovering operation to be usually performed between adjacent lines should be achieved under a condition that a printing operation is temporarily interrupted. In addition, since continuous band-shaped recording paper is used as a recording medium, there does not arise an occasion that recording paper disappears on the conveyance path between adjacent pages like a page printer. In other words a time between adjacent pages is very short. In this embodiment, in view of the foregoing fact, when a request is raised for conducting a recovering treatment during each printing operation, the presently printing label is treated until it is finally printed but a next label is not printed and conveyance of the unrolled paper 204 is interrupted. In fact, this treatment is called precedent treatment for blank paper. After completion of the precedent treatment for blank caper, recovering treatment is conducted.

When a printing operation is restarted as it is, there appears useless paper which is not printed. To cope with the foregoing malfunction, heading is effected by back-feeding of the unwound paper 204. This treatment is called subsequent treatment for blank paper.

The back-feeding is achieved by reversing the conveyance belt 212 of the paper feeding unit 202 and the unrolled paper conveyance belt of the roll feeding unit 201. At this time, a loop is formed and a loop plate 206 is raised up. When a loop sensor 207 is turned on, the conveying belt 205 is reversely operated. When it is found that no loop is formed, the loop plate 206 is lowered, and the loop sensor 207 is turned off, operation of the conveying belt 205 is interrupted. In other words, the relationship between ON and OFF of the loop sensor 207 as well as driving and stopping of the conveying belt 212 is reversed between the printing operation and the no-printing operation. Since operation of the conveying belt 205 is reversed as the conveyance belt 212 runs in the reverse direction, reverse operation can be achieved while adequately maintaining the tension of the unwound paper. The back-feeding is achieved in such a manner that the printing medium is returned by the preliminarily memorized distance equal to a length of single label. At this time, the back-feeding may be terminated when it is determined that heading of the unwound paper 204 is completed by detecting TOF while the TOF sensor 208 is monitored. The stopping time of each printing operation can suppressively shortened by conducting a step of subsequent treatment for blank paper and recovering treatment in the parallel relationship.

When the small resin rollers 250 each having a small frictional coefficient between the roll-shaped paper and the roller 250 as shown in FIG. 35 is substituted for the conveying halt 205 of the roll feeding unit 201, slippage takes place with the rollers 250 when a high intensity of tension is applied to the roll-shaped paper. Running of the unwound paper in the rearward direction can be effected with an adequate intensity of tension without any necessity for controlling the tension with the aid of the loop sensor 207.

(7) Recovering Treatment for the Head

The following description will be made with the assumption that each step is abbreviated to S throughout all flowcharts.

Figure 21:
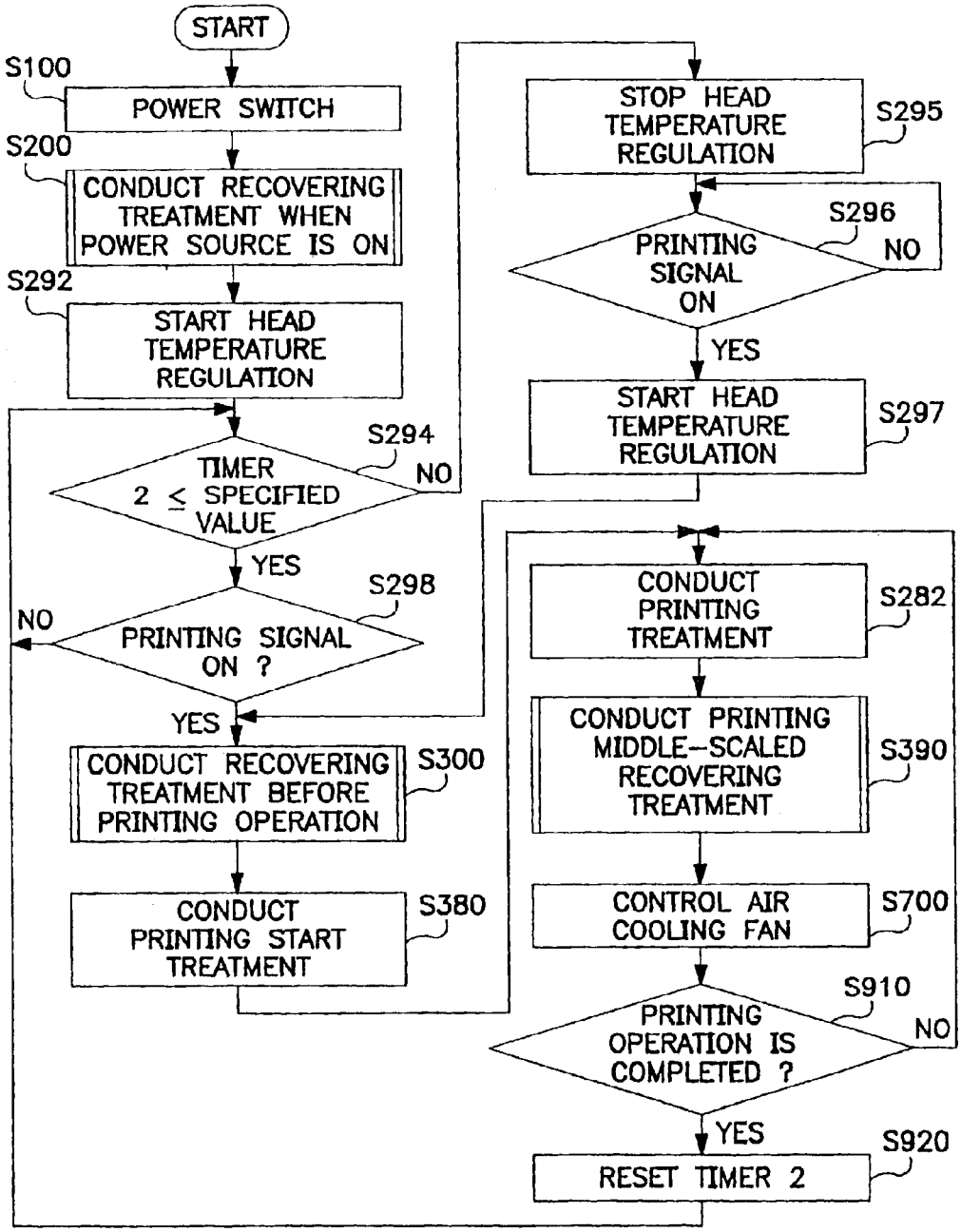

FIG. 21 is a flowchart which shows a series of printing operations to be performed from the time when a power source is turned on till the time when it is turned off. When the power source is turned on, various kinds of timers and counters are reset (S100) and power-on recovering treatment is conducted (S200). Next, the temperature regulation of the head is started by a subheater disposed in the head (S292). Next, it is determined whether a value derived from a timer 2 to be described later is equal to or smaller than a specified value (S294). If it is equal to or larger than the specified value, head temperature control regulation is stopped (S295). When a printing signal is inputted into controller (not shown) after the controller waits in the stopped state (S296), the head temperature control is restarted (S297). When the value of the timer 2 is equal to or smaller than the specified value at S294, the controller waits until the printing signal is inputted (S298), and when the printing signal is inputted into the controller, recovering treatment prior to printing is conducted (S300). This recovering treatment prior to printing is conducted for the head to be held in an optimum state when printing operation is performed. Thereafter, treatment for starting a printing operation is conducted (S380). Once printing operation is started, printing treatment (S382), recovering treatment during printing operation (S390) and controlling for a cooling fan (S700) are repeatedly performed until printing operation is completed. Recovering treatment during printing operation is performed so as to allow the head to be held at the best condition during printing operation. When printing operation is completed (S910), the value of the timer 2 is reset (S920). Treatments from S294 to S920 are repeated until the power source is turned off.

Next, each subroutine will be described below.

(7.1) Power-On Recovering Treatment (S200)

Figure 22:
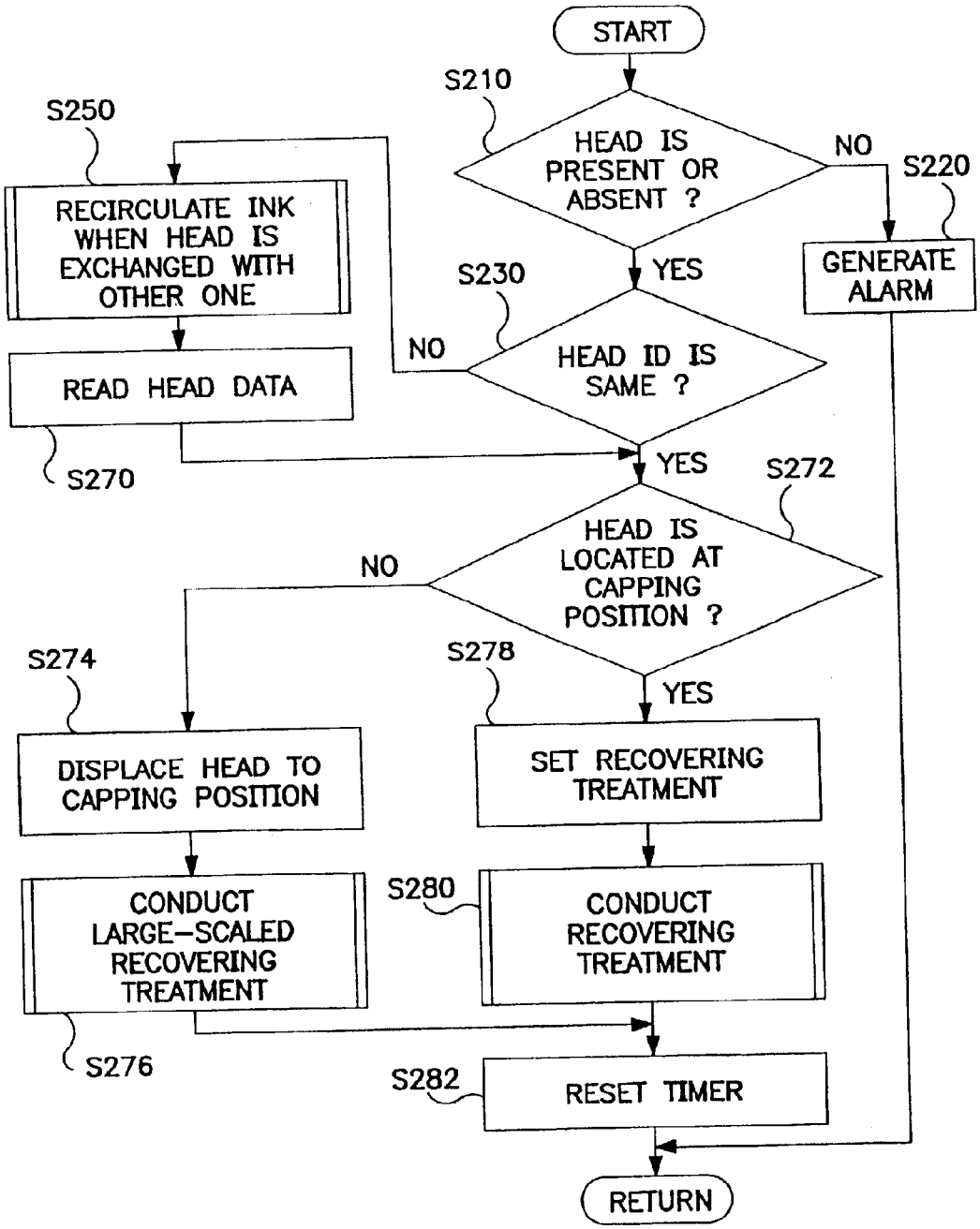

FIG. 22 is a flowchart which shows details on the power-on recovering treatment (S200) as shown in FIG. 21. When the power-on recovering treatment is started, it is determined whether the head is present in the head holder (S210). If no head is present in the head holder, the controller issues alarm (S220), and thereafter, the program returns upper (parent) routine. If the head is present in the head holder, the controller reads head ID from memorizing means mounted on the head (S230), and if the ID is different form the one which was read before, it is determined that the head is exchanged and ink is caused to recirculate during head exchanging (S250). The ink is recirculated to discharge from the interior of the head ink filled in a new head. Next, various kinds of data required for ink election are read from memorizing means mounted on the head and stored in the label printer (S270) Next, it is determined whether the head is present at the capping position (S272). In the case that the head is not present at the capping position, since there is a high possibility that the head is held in the state unsuitable for printing operation due to ink drying or dust adhesion while the power source is turned off, the head is displaced to the capping position (S274), and thereafter, large-scaled recovering treatment is conducted (S276). In the case that the head is present at the capping position, recovering treatment is selected (S278). Specifically, when a value of the timer A incorporated in the CPU 1153 is equal to or smaller than a set time, e.g., 16 hours or less, middle-scaled recovering treatment is selected and when it is larger than the set time, a large-scaled recovering treatment is selected. Next, selected recovering treatment is conducted (S280). On completion of the recovering treatment, values of timer A and timer B each incorporated in CPU 1153 are reset. When large-scaled recovering treatment is selected at S278, values of timer A and timer B are reset if middle-scaled first recovering treatment is selected at S278, value of timer B is reset (S282), and thereafter, the program returns to parent treatment.

Figure 23:
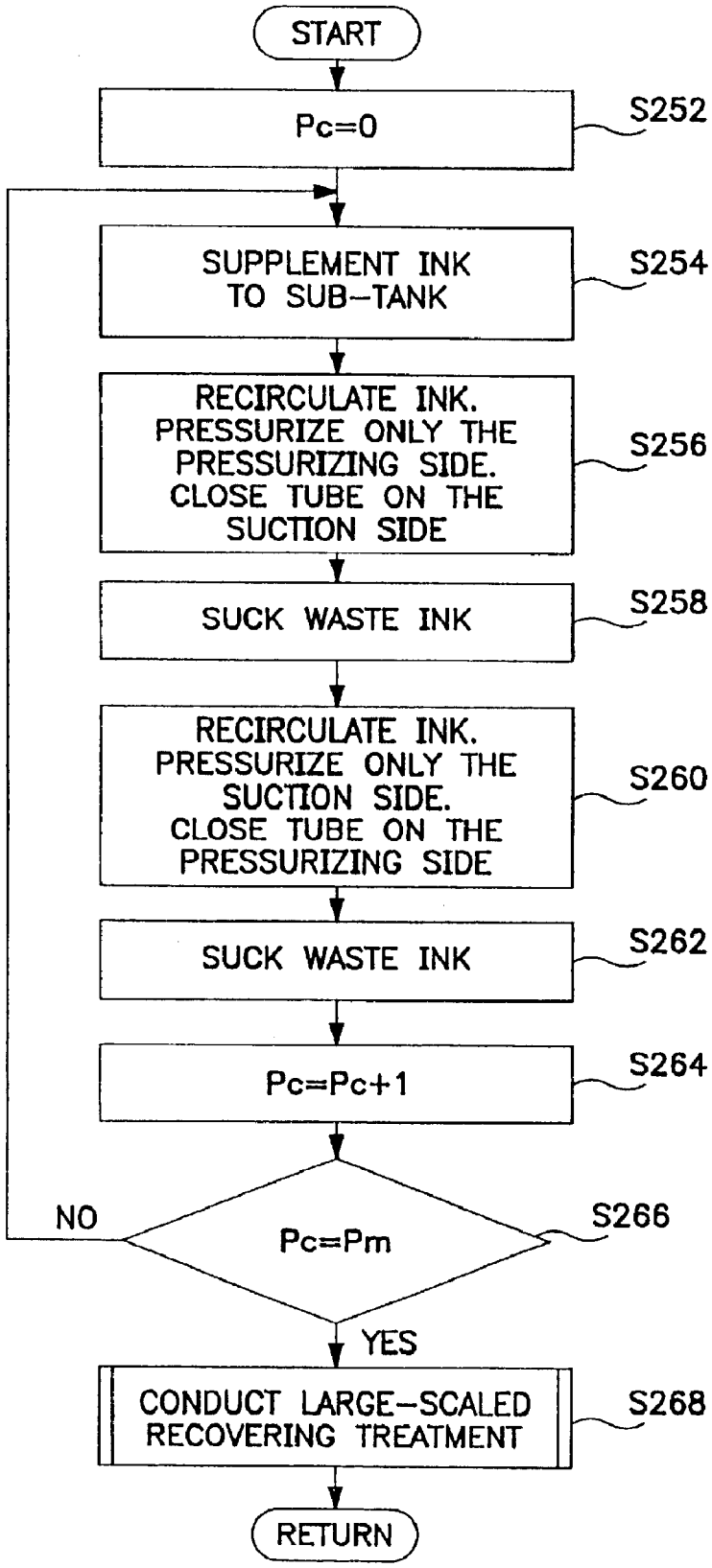
FIG. 23 is a flowchart which shows the content of ink recirculating treatment when the ink jet head is held in the unwound state.

FIG. 23 shows details on ink recirculation (S250) at the time of exchange of the head shown in FIG. 22. First, counter Pc in CPU 1153 is reset to zero (S252), and then, ink is supplemented to subtank from ink cartridge (S254). Next, ink is pumped from the pressurizing side of the head ink feeding path for a first predetermined period of time (S256). At this time, the suction side of the head ink feeding path is kept closed, and waste ink in the recovering system is sucked. Subsequent to completion of the pumping operation of ink, waste ink is sucked for a predetermined second period of time (S258). Thereafter, ink is pumped through the suction side of the head ink feeding path for a predetermined third period of time (S260). At this time, the pressurizing side of the head ink feeding path is kept closed, and waste ink in the recovering system is sucked. Subsequent to completion of the pumping operation, waste ink is sucked for a predetermined fourth period of time (S262). Next, a numeral of 1 is added to the counter Pc (S264), and it is determined whether Pc=specified value Pm or not (S266). If not, the program returns to S254. On he contrary, if so, large-scaled recovering treatment is conducted (S268), and then, the program returns to upper routine.

(7.2) Recovering Treatment Prior to Printing Operation (S300)

Figure 24:
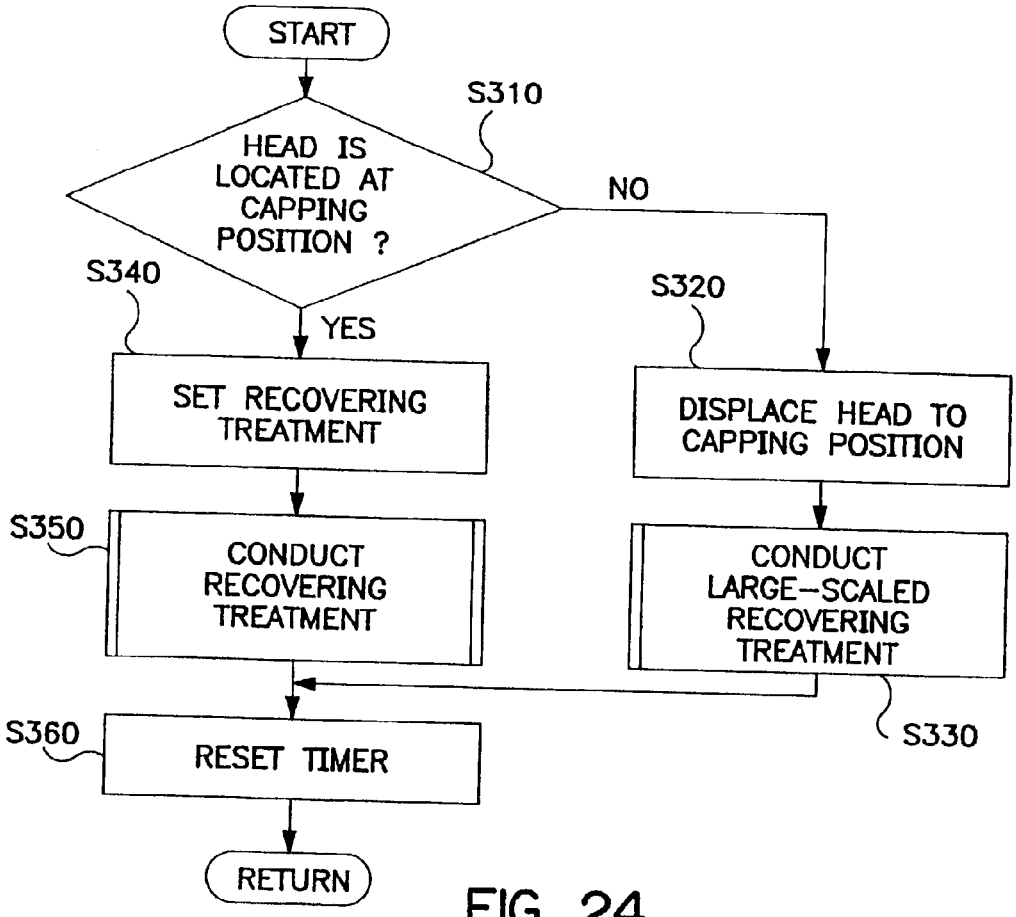
FIG. 24 is a flowchart which shows the content of recovering treatments to be conducted before a printing operation is performed.

FIG. 24 shows details on recovering treatment prior to printing operation (S300). CPU 1153 determines whether the head is located at the capping position or not (S310). In the case that the head is located at the capping position, it is considered that some trouble occurred during a period of standby. For this reason, the head is displaced to the capping position (S320) where large-scaled recovering treatment is conducted (S330). In the case that the head is present at the capping position, recovering treatment is selected (S340). Specifically, when value of timer B is equal to or larger than a specified value, large-scaled recovering treatment is selected, and when it is smaller than the specified value, middle-scaled first recovering treatment is selected. Next, the thus selected recovering treatment is conducted (S350). On completion of the recovering treatment, values or timer A and timer B are reset. If large-scaled recovering treatment is selected at S340, values of timer A and timer B are reset and when middle-scaled recovering treatment is selected, value of timer B is reset (S360). On completion of the recovering treatment directly before a printing operation, the program returns to upper routine.

Figure 25:
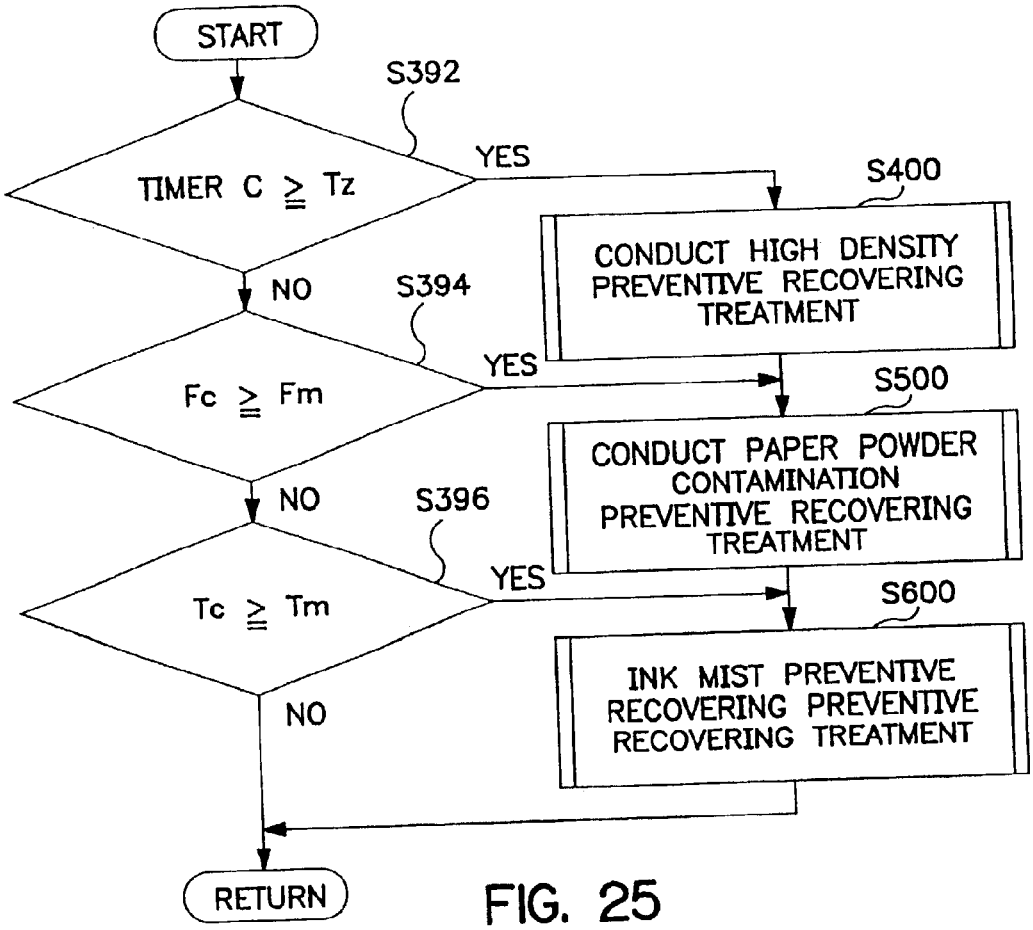
FIG. 25 is a flowchart which shows the content of recovering treatments to be conducted during each printing operation.

(7.3) Recovering Treatment in the Course of a Printing Operation:

FIG. 25 shows details on recovering treatment in the course of a printing operation. When a printing operation is started, CPU 1153 compares a value of a timer C incorporated in the CPU 1153 with a specified value Tz (S392). When the value of the timer C is equal to or larger than the specified value Tz, high density preventive recovering treatment (400) is conducted, and then, the program returns to upper (parent) routine. If the value of the timer C is not equal to or larger than the specified value Tz, a value of a feed clock counter Fc is compared with a specified value Fm (S394). If the value of the feed clock counter Fc is equal to or larger than the specified value, paper powder contamination recovering treatment is conducted (S500), and then, the program returns to upper (parent) routine. If the feed clock counter Fc does not coincide with the specified value Fm, a value of an ink droplet ejection counter Tc is compared with a specified value Tm (S396). If it is equal to or larger than the specific value Tm, ink mist recovering treatment (S600) is conducted, and then, the program returns to upper (parent) routine. If it does not coincide with the specified value Tm, the program skips S600 and returns to upper treatment.

Figure 26:
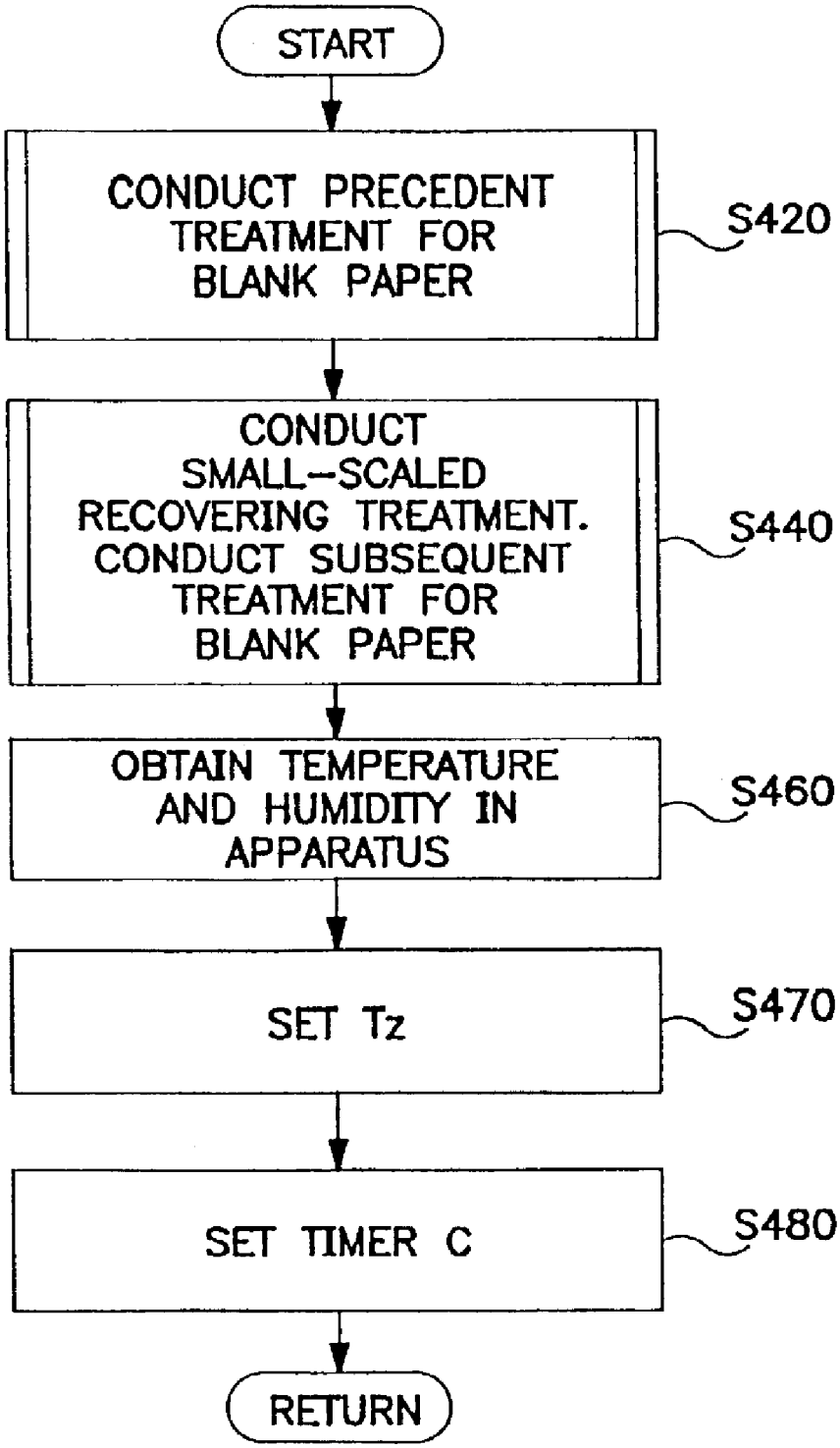
FIG. 26 is a flowchart which shows the content of high density preventive recovering treatments to be conducted.

FIG. 26 is a flowchart which shows details on high density preventive recovering treatment (S400). Some ink ejection ports do not eject ink during printing operation depending on image data with which a user wants to print an image. Ink in these ink ejection ports has an increased concentration due to vaporization of volatile components in ink from these ink ejection ports. If the ink ejection ports which have not been used for a long period are brought in use due to variation of bar code data and numerical data, a printed image has an increased density. To prevent image density from varying, high density preventive recovering treatment (S400) is conducted.

When high density preventive recovering treatment starts, precedent treatment for blank paper (S420) is conducted, and moreover, small-scaled recovering treatment and subsequent treatment for blank paper are conducted (S440). Thereafter, temperature and moisture in the label printer are adjustably determined (S460). Time interval Tz for small-scaled recovering treatment is selectively determined using data on the thus determined temperature and humidity (S470). The time interval Tz for small-scaled recovering treatment is determined to be short as the temperature is higher and the humidity is lower. Thereafter, the value of the timer C is reset (S480), and then, the program returns to (parent) treatment.

Figure 27:
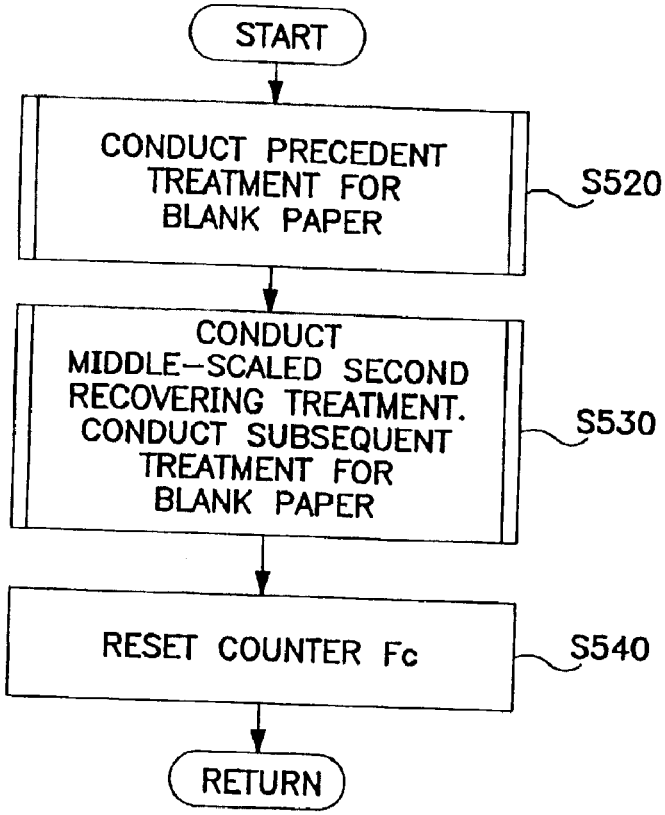
FIG. 27 is a flowchart which shows the content of paper powder contamination preventive recovering treatments to be conducted.

FIG. 27 is a flowchart which shows details on the paper powder contamination recovering treatment (S500) shown in FIG. 25. After completion of precedent treatment for blank paper (S520), middle-scaled second recovering treatment and subsequent treatment for blank paper are conducted, a printing operation is restarted (S530), and a counter Fc is reset (S540). This recovering treatment is conducted to remove powder particles of printing medium donor adhering to the ink ejection port forming surface during each printing operation and moreover, prevent an occurrence of malfunctions that ink fails to be ejected and ink is incorrectly ejected in the direction with undesirable departure (inclination) from the given direction.

Figure 28:
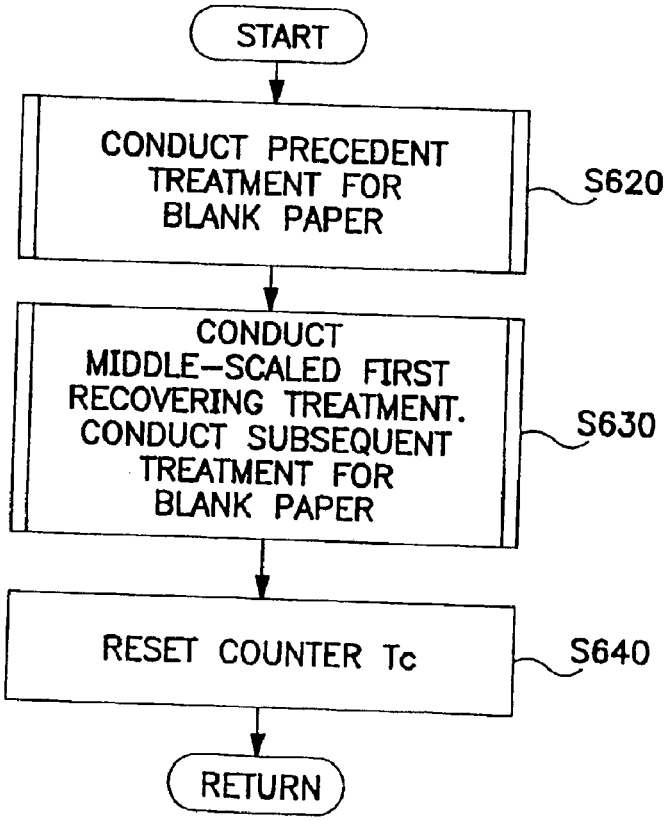
FIG. 28 is a flowchart which shows the content of ink mist preventive recovering treatments to be conducted.

FIG. 28 is a flowchart which shows details on the ink mist preventive recovering treatment (S600) as shown in FIG. 25. Precedent treatment for blank paper is conducted (S620), middle-scaled first recovering treatment and subsequent treatment for blank paper are conducted, printing operation is restarted (S630), and counter Tc is reset (S540). The ink mist preventive recovering treatment is intended to remove ink mist adhering to the ink ejection port forming plane during each printing operation.

(7.4) Controlling of an Air Cooling Fan (S700):

Since a full line head is used for the label printer, each printing operation is achieved without any displacement of the head in the main scanning direction as seen with a serial printer but only with displacement of a recording paper in the auxiliary scanning direction. For this reason, there does not arise any necessity for air cooling to be effected as the head is displaced like the serial printer. However, since a quality of printed image is degraded when the temperature of the head is excessively elevated, forcible air cooling is effected by rotating a fan. In other words, an image having stable quality is obtainable by suppressing the elevation of the head temperature.

As shown in FIG. 4, an air cooling fan unit 7 is fitted in parallel to the longitudinal direction of the head. With this construction, air stream can smoothly flow between adjacent heads. When head cooling air stream reaches the ink ejection port forming surface during printing operation, there arise problems that a printed image is deformed, and moreover, ink mist is generated. To cope with the foregoing problems, the label printer is constructed such that each head is brought into an opening in the slotted recovering system units 3 during each printing operation. Thus, no head cooling air stream reach the ink ejection port side.

Since controlling the cooling fan unit 7 is conducted in the state that the recording head ejection port forming surfaces are brought into openings in the slotted recovering system unit in recording operators, the air stream does not affect the recording head ejection port forming surfaces, thus preventing deformation of print and ink mists smaller than ink droplets from being generated. As a result, high quality printing is achieved. Moreover, since printing is performed even in controlling the cooling fan, reduction of throughput is prevented and high speed printing is achieved.

Next, details on the controlling of an air cooling fan (S700) shown in FIG. 21 will be made below with reference to FIG. 29. First, an output from the temperature sensor disposed in each head is converted with the aid of an A/D converter disposed in CPU 1153 to detect the temperature of each head. Head temperature is detected with respect to four heads corresponding to four colors Bk, C, M and Y (S710). Data Ts on the highest temperature is selected (S720). The highest temperature data Ts is compared with critical printing temperature Tmax (S730). If Ts>Tmax, head temperature abnormality treatment is conducted (S800). If Ts≦Tmax at S730, the program jumps to S750. The selected head temperature Ta is compared with a predetermined fan driving temperature Th (S750). If Ts≦Th, the program returns to upper (parent) treatment. If Ts≧Th, the cooling fan is rotationally driven (S760), each head temperature is detected again (S770), and data Ts on the highest temperature among the four head temperature data is selected (S780). The selected head temperature Ts is compared with a predetermined fan stop temperature T1 (S790). If Ts≦T1, rotation of the fan is stopped (S795), and then, the program returns to upper (parent) routine. If Ta>T1 at S790, the program returns to upper (parent) routine without any stoppage of rotation of the fan.

In the case that a user continuously prints data each having a very high black rate at a high speed, the temperature of each head is elevated. When the head temperature is elevated in excess of a limit of controlling of a air cooling fan, it is anticipated that not only a quality of printed image is degraded but also each head is damaged or injured. In view of the foregoing fact, a printing speed of the label printer is changed to another one and each printing operation is stopped in association with the head temperature abnormality treatment (S800) shown in FIG. 29.

Figure 29:
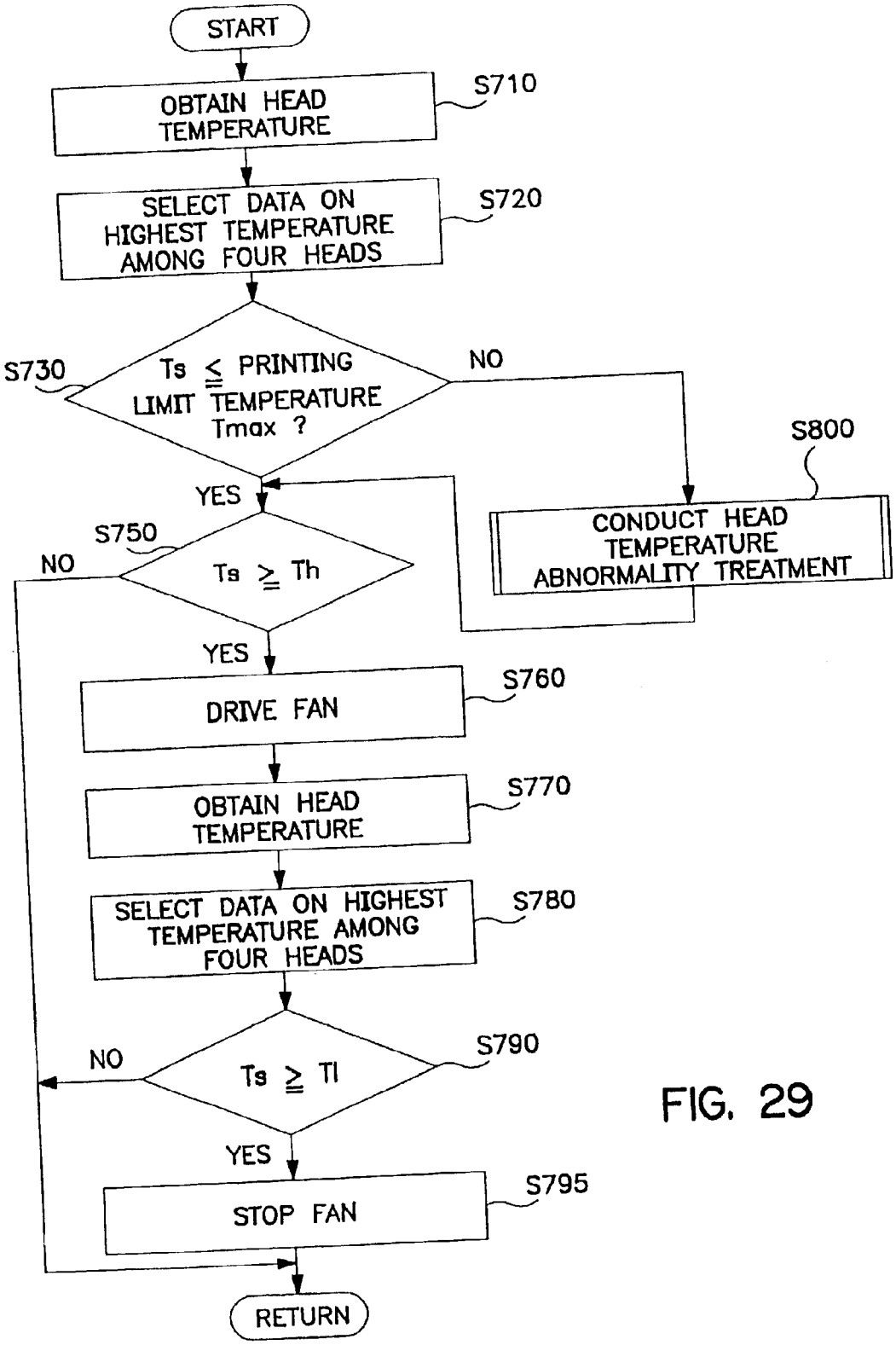
FIG. 29 is a flowchart which shows the content of air cooling fan controlling treatments to be conducted.
Figure 30:
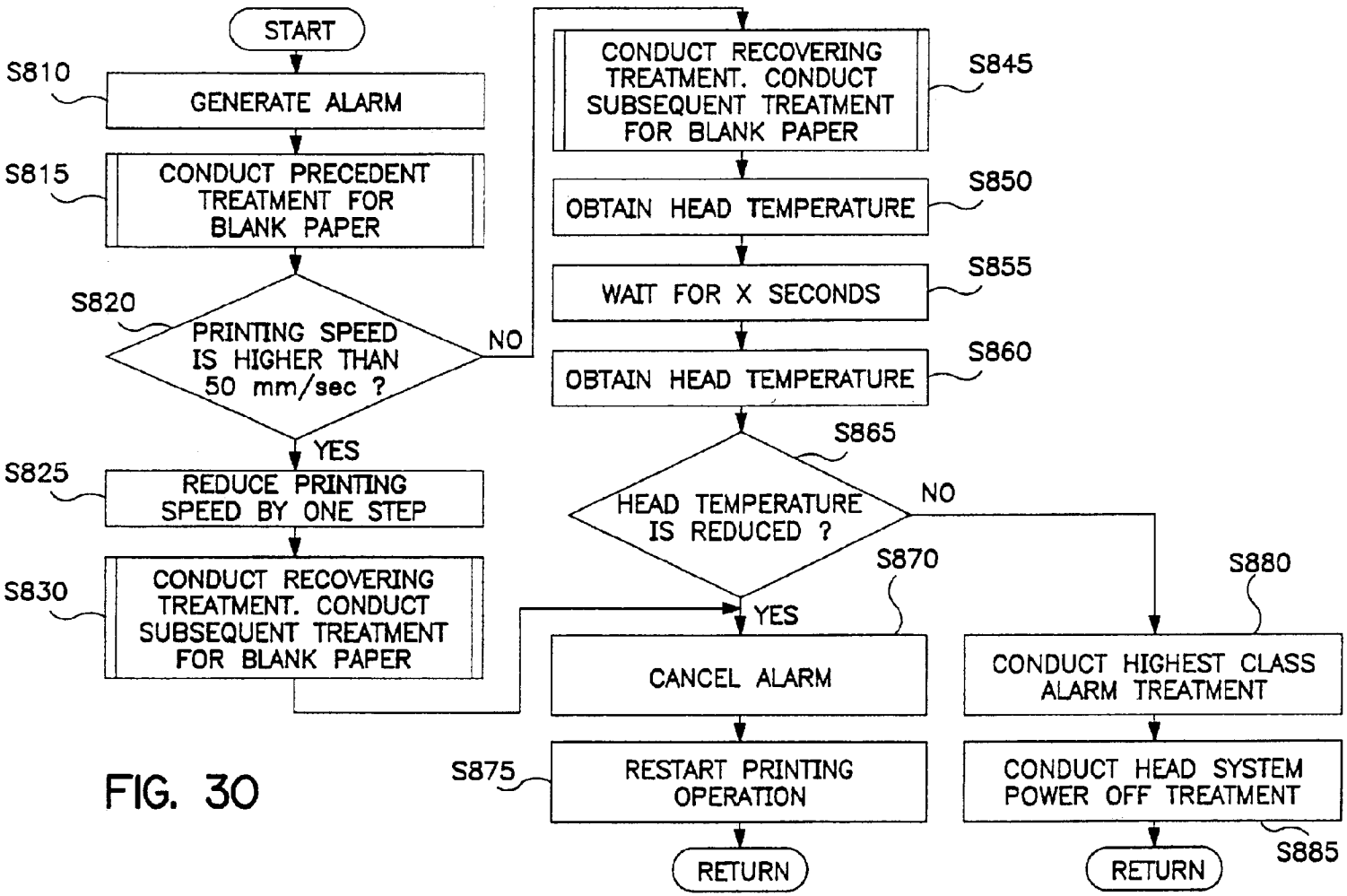
FIG. 30 is a flowchart which shows the content of ink jet head temperature abnormality treatments to be conducted.

FIG. 30 shows details on the head temperature abnormality controlling (S800) shown in FIG. 29. When head temperature abnormality is detected, alarm is issued to a user (S810), precedent treatment for blank paper is conducted (S815), and thereafter, a printing speed is compared, with 50 mm/sec (S820). If printing speed ≧50 mm/sec, the printing speed memorized in CPU 1153 is reduced by one stage (S825). Next, subsequent treatment for blank paper and recovering treatment are conducted (S830), the user is released from the alarmed state (S870), and then, a printing operation restarts (S875).

If printing speed<50 mm/sec at S820, recovering treatment and subsequent treatment for blank paper are executed (S485), and then, each head temperature is detected (S850). After the label printer is held in the standby state for a period of X seconds (S855), each head temperature is detected (S860) and it is determined whether the head temperature is lowered or not (S865). If the head temperature is lowered, the user is released from the alarmed state (S870), and then, the printing operation restarts (S875). If the head temperature is not lowered at S865, it is considered that this is attributable to the fact that energy is continuously fed to the head. Thus, a most severe alarm is issued to the user (S880). Next, feeding of electricity to the head system is interrupted (S885), and then, the program returns to upper (parent).

Figure 31:
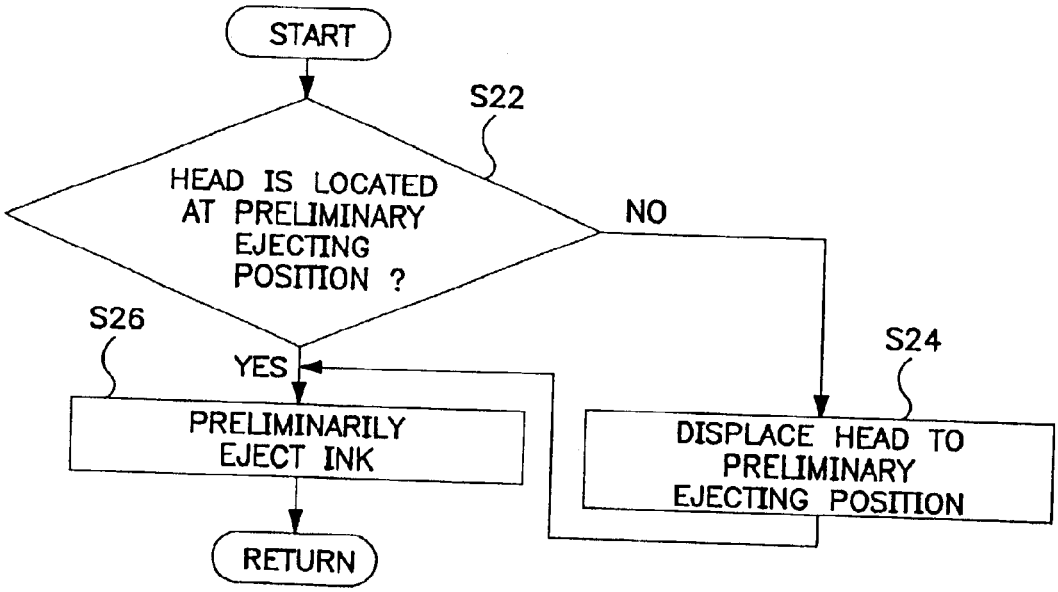
FIG. 31 is a flowchart which shows the content of small-scaled recovering treatments to be conducted.

(7.5) Small-scales recovering treatment, middle-scaled recovering treatment and large-scaled recovering treatment The detail of small-scaled recovering treatment is described below with reference to FIG. 31. It is determined whether each head is located at the position where preliminary ejection can be conducted (S22). If the head is not located at the position where preliminary ejection can be conducted, the head is displaced to a preliminary ejection position (S24), and preliminary ejection is conducted at the foregoing position (S26). Once preliminary ejection is conducted, a predetermined number of ink droplets are ejected from the head.

Figure 32:
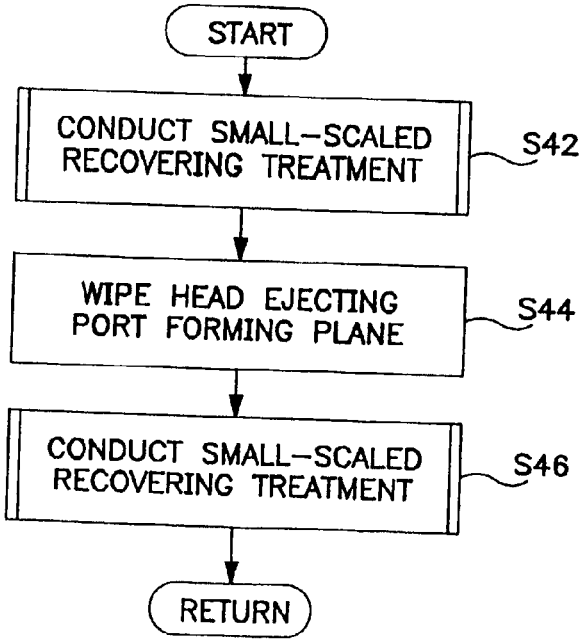
FIG. 32 is a flowchart which shows the content of middle-scaled first recovering treatments to be conducted.

The detail of middle-scaled first recovering treatment is described below with reference to FIG. 32. First, small-scaled recovering treatment is conducted (S42), thereafter, the ink ejection port forming plane of the head is wiped using an elastic material (S44), and then, small-scaled recovering treatment is conducted again (S46).

Figure 33:
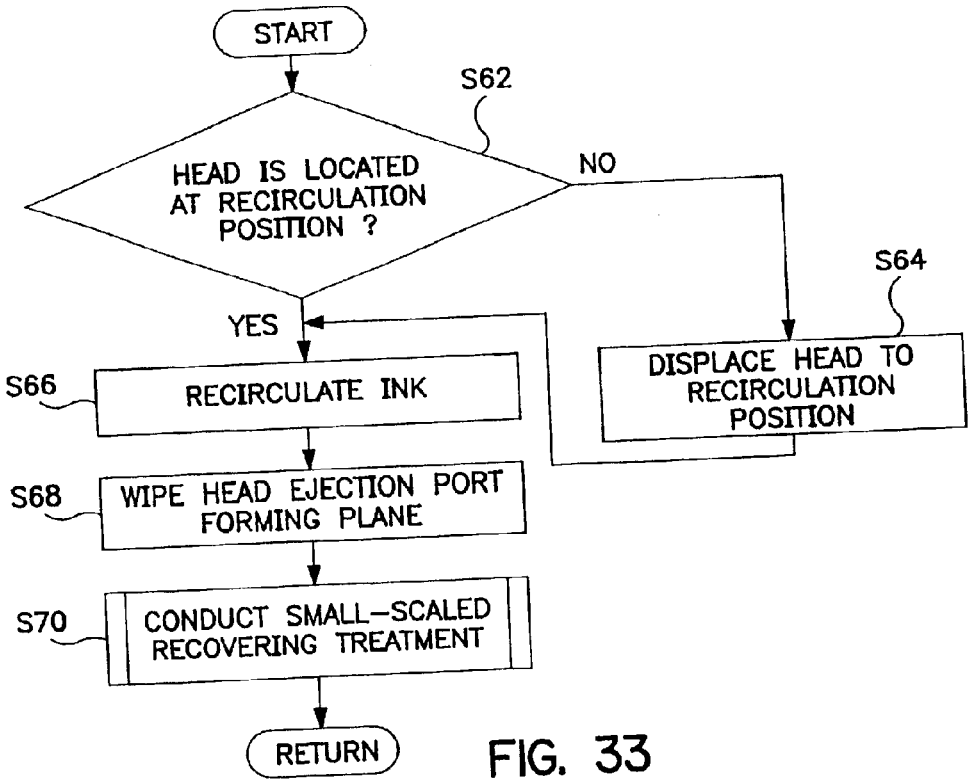
FIG. 33 is a flowchart which shows the content of middle-scaled second recovering treatments to be conducted.

The detail of middle-scaled second recovering treatment is described below with reference to FIG. 33. First, it is determined whether each head is located at the position where ink can recirculate (S62). If the head is not located at the position where ink recirculates, the head is displaced to an ink recirculation position (S64). Next, ink recirculating treatment is conducted (S66). Thereafter, a wiping operation is performed (S68), and then, small-scaled recovering treatment is conducted (S70).

Figure 34:
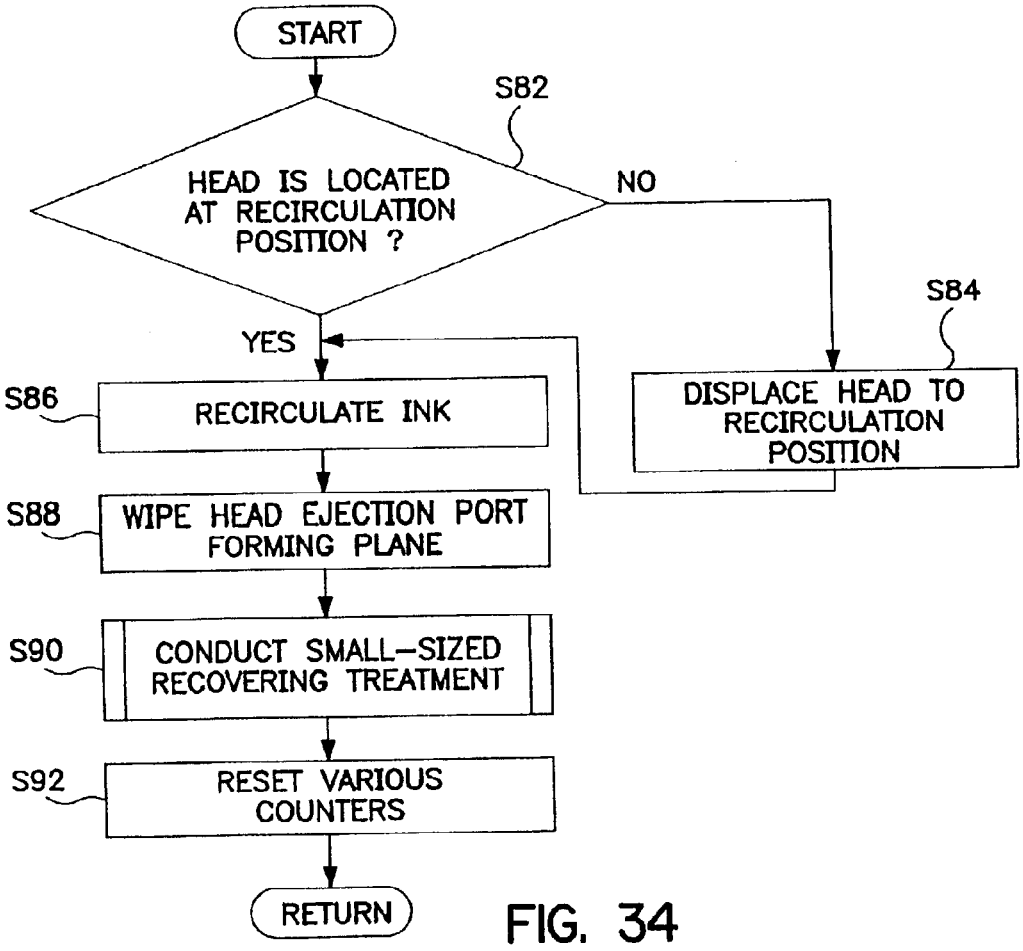
FIG. 34 is a flowchart which shows the content of large-scaled recovering treatments to be conducted.

The content of large scaled recovering treatment will be described below with reference to FIG. 34. First, it is determined whether each head is located at the position where ink can recirculate (S82). If the head is not located at the position, the head is displaced to an ink recirculating position (S84). Next, ink recirculating treatment is conducted (S86). Thereafter, a wiping operation is performed (S88), small-sized recovering treatment is conducted (S90), and then, a counter, a timer and others are reset (S92).

Others

In this embodiment, since an ink jet head is used for the label printer, advantages specific to the ink jet head as mentioned above at many locations are obtainable. In addition to these advantages, the label printer exhibits the following remarkable advantages.

When bar codes each extending in the direction perpendicular to the line head (i.e., in the printing paper conveying direction) are printed using a thermal head, particular heat generating elements are continuously driven. This leads to the problem that heats accumulated in these heating elements. Especially, the subsequently printed upper part of each bar code as viewed in the direction of height of the bar code is printed with a large width compared with the precedently printed lower part of the same because of hear accumulation, in the heat generating elements. For this reason, there arises a necessity for controlling a quantity of energy to be applied to each heat generating elements.

On the other hand, when a printing operation is performed in the direction of the line head or the like other than the conveying direction, a number of heat generating elements continuous with the direction of arrangement of heat generating elements for a full-multi head are simultaneously driven, causing heat to be accumulated in he heat generating elements. Thus, part, of the printing medium, to be not printed is heated due to heat accumulation with the result that a tail like stripe appears on the foregoing part of the printing medium with a quality of printed image adversely affected. Especially, in the case of bar codes each having a printing accuracy recognized as an important factor, a gap between adjacent unprinted bar codes is disturbed, resulting in the detection accuracy of each bar code being largely adversely affected.

In addition, when a recording operation is performed while the temperature of each heating element is kept low (after the unprinted line continues), each color can not sufficiently visually be recognized. Thus, there is a possibility that a fine line is recorded with such a density that it can not exactly be detected by a bar code scanner.

In the circumstances as mentioned above, it is necessary to control heat generating elements in the following manner. Specifically, with respect to a heat generating element which does not participate in recording, it is controlled such that each color can sufficiently visually be recognized at the time of next recording operation. With respect to a heat generating element which participate in continuous recording, it is controlled such that its temperature is not excessively elevated.

In consideration of the aforementioned facts, it is advantageous go utilize an ink jet head.

Among various kinds of ink jet recording systems, the present invention is concerned with a recording head or a recording apparatus of the type which includes means for generating thermal energy (e.g., electrothermal transducers, a laser light beam or the like) to be utilized for ejecting ink therefrom, and moreover, causing the state of ink to vary by thermal energy. According to such a system as mentioned above, each recording operation can be achieved not only at a high density but also at a high accuracy while assuring distinct advantageous effects inherent to this system.

With respect to a typical structure and an operational principle of the foregoing system, it is preferable that reference is made to official gazettes of U.S. Pat. Nos. 4,723,129 and 4,740,796 each of which discloses a basic principle of the foregoing type of system. Although this system can be applied to a so-called on-demand type ink jet recording system and a continuous type ink jet recording system, it is particularly suitably employable for operating in the form of an on-demand type recording apparatus. This is because the on-demand type recording apparatus includes electrothermal transducers each disposed corresponding to a sheet of paper or a liquid path having liquid (ink) retained therein and operates in the following manner. In response to at least one driving signal applied to the electrothermal transducers to induce sudden temperature rise in excess of appearance of a phenomenon of nucleate boiling in the liquid, thermal energy is generated in the thermal transducers, causing a phenomenon of film boiling to appear on the heating portion of a recording head. This leads to the result that gas bubbles are grown in the liquid (ink) corresponding to a driving signal in the one-to-one relationship. By using the growth and collapse of the gas bubbles, at least one liquid droplet is ejected from ink ejecting ports. The driving signal in the form of a pulse is preferably employable because the growth and collapse of the gas bubbles can instantaneously be achieved, resulting in the liquid (ink) being ejected with excellent responsiveness. As driving signals to be outputted in the form of a pulse, those described in official gazettes of U.S. Pat. Nos. 4,463,359 and 4,345,262 are preferably employable. Incidentally, when conditions described in an official gazette of U.S. Pat. No. 4,313,124 which is concerned with the rate of the temperature rise of the heating portions of the recording head are employed, a more excellent recording operation can be performed.

With respect to the structure of the recording head, it is recommendable that reference is made to official gazettes of U.S. Pat. Nos. 4,558,333 and 4,459,600 both of which are incorporated in the present invention. According to these prior inventions, the structure including heating portions disposed on bent portions of the recording head in addition to a combination made among the ink ejecting ports, the liquid paths (linearly extending liquid flow paths or flow paths extending at a right angle relative to the preceding ones) and the electrothermal transducers is disclosed in the official gazettes of the foregoing prior inventions. In addition, the present invention can advantageously be applied to the structure disclosed in an official gazette of Japanese Patent Laid-Open Publication NO. 59-123670 so as to allow a common slit to be used as ejecting portions for a plurality of electrothermal transducers. Additionally, the present invention can likewise advantageously be applied to the structure disclosed in an official gazette of Japanese Patent Laid-Open Publication NO. 59-138461 so as to allow opening portions for absorbing pressure waves caused by the thermal energy to be used as ejecting portions. Thus, irrespective of the type of the recording head, the present invention assures that each recording operation can reliably be achieved at a high efficiency.

Further, the present invention can advantageously be applied to a full line type recording head having a length equal to the maximum width of a recording medium with which each recording operation can be performed by operating the recording apparatus. This type of recording head is exemplified by a recording head having such a structure that a condition relating to the foregoing length is satisfied by combining a plurality of recording heads with each other and a single recording head having an integral structure.

It is preferable that preliminary assisting means or the like are added to the recording apparatus because advantageous effects of the present invention can be stabilized further. Concretely, the preliminary assisting means is exemplified by capping means for the recording head, cleaning means, electrothermal transducers, heating elements different from the electrothermal transducers, preliminary heating means adapted to effect heating in combination of the electrothermal transducers with the heating elements, and preliminary ejecting means adapted to effect ejecting separately from recording.

The kind and the number of recording heads to be mounted on the recording apparatus can also be changed as desired. For example, only one recording head corresponding to a monochromatic ink is acceptable. In addition, a plurality of recording heads corresponding to plural kinds of inks each different in printing color or concentration are also acceptable. For example, as a recording mode employable for the recording apparatus, the present invention should not be limited only to a recording mode having a main color such as a black color the like used therefor. Although the recording head may be constructed in an integral structure or a plurality of recording heads may be combined with each other, the recording apparatus including at least one recording mode selected from recording modes based on plural colors each having a different color and a recording mode based on full color prepared by mixing plural colors is very advantageously employable because bar codes have shortage in number, causing colored bar codes to be taken into account.

In each of the embodiments of the present invention as described above, each ink to be used has been explained as a liquid. Alternatively, ink which is kept solid at a room temperature equal to or lower than the room temperature but softened or liquidized at the room temperature may be used. In the ink jet system, since the temperature of ink to be used is generally controllably adjusted within the temperature range of 30° C. or more to 70° C. or less so as to allow the viscosity of the ink to be maintained within the stable ejecting range, ink which is liquidized when a recording signal is applies to the recording heat may be used. To positively prevent the temperature of ink from being elevated due to the thermal energy applied to the recording head by utilizing the energy arising when the solid state of ink is transformed into the liquid state or to prevent the ink from being vaporized, ink which is kept solid in the unused state but liquidized on receipt of heat may be used. At any rate, the present invention can be applied to the case that in response to a recording signal, ink is liquidized on receipt of thermal energy and the liquid ink is then ejected from the recording head, the case that ink starts to be solidified when an ink droplet reaches a recording medium, and the case that ink having such a nature that it is liquidized only in response to application of thermal energy to the recording head is used. In such cases, while ink is retained in concavities or through holes formed in a porous sheet material in the form or a liquid substance or a solid substance, the ink may face to the electrothermal transducers as described in an official gazette of Japanese Patent Laid-Open Publication NO. 54-56847 or an official gazette of Japanese Patent Laid-Open Publication NO. 60-71260. According to the present invention, a most advantageous result can be obtained with any one of the aforementioned kinds of inks when the film boiling system is executed.

In addition, the ink jet recording apparatus of the present invention can be employed not only as an image output terminal of an information processing apparatus such as a computer or the like but also as an output apparatus of a copying machine combined with an optical reader and as an output apparatus of a facsimile apparatus having a sending/receiving function.

As is apparent from the above description, according to the present invention, the ink discharged at the time of preliminary ink ejection or at the time of recirculation of ink in each ink jet head can be absorbed in an ink absorbing member by allowing the ink absorbing member to come near to an ink ejecting port forming plane while facing to the plane with a predetermined gap held therebetween. In addition, a large-sized liquid droplet can be absorbed in the absorbing member by sufficiently reducing a gap between ink ejecting ports of ink jet head and the absorbing member.

Further, since the absorbing member is disposed in a cap serving to cap the ink ejecting ports forming plane of the ink jet head, large ink droplets or water droplets adhering to the ink ejecting port forming plane due to deposition of ink mist or dewing on the same can be absorbed in the absorbing member in the capping state. The ink ejecting ports forming plane can be maintained under a good condition by bringing a wiping member in contact with the ink ejecting ports forming plane so as to wipe the plane with the wiping member.

Additionally, according to the present invention, the recovering apparatus includes a plurality of ink jet heads and a plurality of recovering means corresponding to the ink jet heads, and the recovering means are arranged with a narrow space between adjacent recovering means enough for the ink ejecting port side of each ink jet head to pass therethrough. With this construction, heads located in the space portions can face to the recovering means by moving the recovering means for small amount since each of the heads and each of the recovering means are closed, whereby the movable range of the recovering means or the ink jet head can be set to a small value. Consequently, the whole printer can be designed and constructed with small dimensions.

While the present invention has been described above with respect to preferred embodiments thereof, it should of course be understood that the present invention should not be limited only to these embodiments but various change or modification may be made without departure from the scope of the present invention as defined by the appended claims.

What is claimed is:

1. An ink jet printing apparatus having plural ink jet heads each having an ink ejecting port forming surface provided with ink ejecting ports, for effecting printing on a printing medium, comprising:

an ink recovery assembly including plural ink recovery means spaced apart by gaps through which said ink jet heads project for printing and retract for recovery, each of said recovery means being paired with a corresponding one of said ink jet heads, being adapted to recover ink from said ink jet head in order to maintain an ink ejecting state in a good condition, and having a capping member which contains a first droplet absorbing member to cover said ink ejecting port forming surface, and a wiping member for slidingly wiping said ink ejecting port forming surface;

a driving mechanism for moving said ink jet heads to a printing position where printing is effected and to a distant position which is remote from the printing medium in comparison with the printing position;

a second droplet absorbing member provided for each said ink jet head interposed between a first space for accommodating said ink ejecting port forming surface at the printing position and said ink recovery means and a second space for accommodating said driving mechanism, while permitting said ink jet head to move; and a recovery controller, adapted to effect, for each of said recovery means, a first mode in which said capping member is disposed at a position where said first droplet absorbing member is distant from and opposed to said ink ejecting port forming surface so as to bring said first droplet absorbing member in contact with droplets adhered to said ink ejecting port forming surface in order to absorb the droplets with said first droplet absorbing member, without said first droplet absorbing member contacting said ink ejecting port forming surface; a second mode in which said wiping member contacts with said second droplet absorbing member and said ink ejecting port forming surface is positioned at a more retreated position than that of said second droplet absorbing member from said wiping member; and a third mode in which said wiping member is disposed at a position where said wiping member can contact with said ink ejecting port forming surface, said wiping member slidingly wiping said ink ejecting port forming surface, and removing droplets which are adhered to said ink ejecting port forming surface and which have not been absorbed by said first droplet absorbing member.

2. An apparatus as claimed in claim 1, wherein in said first mode of said recovery controller, pressure is controlled to make said first droplet absorbing member absorb ink discharged from said ink ejecting ports.

3. An apparatus as claimed in claim 1, wherein in said first mode of said recovery controller, large ink droplets adhering to said ink ejecting port forming surface are absorbed by said first droplet absorbing member.

4. An apparatus as claimed in claim 1, wherein in said first mode of said recovery controller, said ink ejecting port forming surface is capped with said capping member.

5. An ink jet printing apparatus having plural ink jet heads each having an ink ejecting port forming surface provided with ink ejecting ports, for effecting printing on a printing medium, comprising:

an ink recovery assembly including plural ink recovery means spaced apart by gaps through which said ink jet heads project for printing and retract for recovery, each of said recovery means being paired with a corresponding one of said ink jet heads, being adapted to recover ink from said ink jet head in order to maintain an ink ejecting state in a good condition, and having a capping member, and a wiping member for slidingly wiping said ink ejecting port forming surface;

a driving mechanism for moving said ink jet heads to a printing position where printing is effected and to a distant position which is remote from the printing medium in comparison with the printing position;

a droplet absorbing member provided for each said ink jet head interposed between a first space for accommodating said ink ejecting port forming surface at the printing position and said ink recovery means and a second space for accommodating said driving mechanism, while permitting said ink jet head to move; and a recovery controller, adapted to effect, for each of said recovery means, a first mode in which said capping member is disposed at a position where said capping member is opposed to said ink ejecting port forming surface so as to receive droplets ejected from said ejecting port forming surface, a second mode in which said wiping member contacts with said droplet absorbing member and said ink ejecting port forming surface is positioned at a more retreated position than that of said droplet absorbing member from said wiping member, and a third mode in which said wiping member is disposed at a position where said wiping member can contact with said ink ejecting port forming surface, said wiping member slidingly wiping said ink ejecting port forming surface, and removing droplets which are adhered to said ink ejecting port forming surface.

6. An ink jet printing apparatus as claimed in claim 5, wherein the capping member of each said recovery means is provided for capping a face of the corresponding ink jet head, the capping member having an absorbing member facing said face with a predetermined distance therebetween in a capping state by said cap.

7. An ink jet printing apparatus as claimed in claim 5, wherein each wiping member is moved in a direction which is parallel to a face of the corresponding ink jet head by a recovery means moving mechanism.

8. An ink jet printing apparatus as claimed in claim 5, wherein each of the plurality of ink jet heads includes an element for generating thermal energy used for ejecting ink.

9. An ink jet printing apparatus as claimed in claim 5, further comprising discharge means for discharging ink in said capping member, which receives ink ejected from said ejecting port forming surface, to outside of said capping member.

* * * * *

UNITED STATES PATENT AND TRADEMARK OFFICE

CERTIFICATE OF CORRECTION

PATENT NO. : 6,871,936 B2
DATED : March 29, 2005
INVENTOR(S) : Fujimoto et al.

It is certified that error appears in the above-identified patent and that said Letters Patent is hereby corrected as shown below:

Title page,
Item [30], Foreign Application Priority Data,
"Mar. 11, 1994 (JP)…….6-014612" should read
-- Mar. 11, 1994 (JP)…….6-041612 --.

Column 1,
Line 41, "this" should read -- these --.
Line 46, "or" should read -- of --.

Column 2,
Line 16, "comprising;" should read -- comprising: --.
Lines 24 and 63, "comprise;" should read -- comprise: --.
Line 28, "controlling" should read -- controlling means --.

Column 3,
Line 10, "be to" should be deleted.
Line 19, "of;" should read -- of: --.
Line 39, "steps" should read -- step --.

Column 4,
Line 1, "for" should read -- a --.
Line 12, "another" should read -- other --.

Column 6,
Line 11, "tat" should read -- that --.
Line 17, "Printer." should read -- Printer --.
Line 37, "(no" should read -- (not --.
Line 50, "normally" should read -- normal --.
Line 52, "he" should read -- the --.
Line 54, "is" should read -- to be --.

Column 7,
Line 4, "other" should read -- another --.

Column 8,
Line 15, "lover" should read -- lower --.
Line 46, "the" should be deleted.
Line 47, "opening 38A" should read -- openings 38A --.

Column 9,
Line 32, "he" should read -- the --.

UNITED STATES PATENT AND TRADEMARK OFFICE

CERTIFICATE OF CORRECTION

PATENT NO. : 6,871,936 B2
DATED : March 29, 2005
INVENTOR(S) : Fujimoto et al.

It is certified that error appears in the above-identified patent and that said Letters Patent is hereby corrected as shown below:

Column 10,
Line 25, “disposed)” should read -- disposed). --.
Lines 26 and 27, “few” should read -- little --.
Line 50, “in” should be deleted.

Column 11,
Line 2, “2” should read -- a -- and “or” should read -- for --.
Line 19, “carried” should read -- composed --.
Line 52, “toll” should read -- roll --.
Line 61, “inch” should read -- inches --.

Column 12,
Line 2, “he” should read -- the --.
Line 45, “he loon” should read -- the loop --.

Column 13,
Line 18, “upper” should read -- above --.
Line 61, “being” should read -- being in --.
Line 62, “form” should read -- from --.
Line 64, “drive” should read -- drive at --.

Column 14,
Line 1, “(riot” should read -- (not --.
Line 44, “clatter” should read -- cutter --.
Line 65, “to” should read -- so as to --.

Column 15,
Line 63, “other” should read -- the other --.

Column 16,
Line 16, “as” should read -- is --.
Line 50, “18A)” should read -- 18A). --.
Line 59, “or” should read -- of --.

Column 18,
Line 34, “direction. The” should read -- direction, the --.
Line 37, “a” should be deleted.
Line 61, “pump 301” should read -- pump 304 --.

Column 19,
Line 58, “he” should read -- the --.

UNITED STATES PATENT AND TRADEMARK OFFICE

CERTIFICATE OF CORRECTION

PATENT NO. : 6,871,936 B2
DATED : March 29, 2005
INVENTOR(S) : Fujimoto et al.

It is certified that error appears in the above-identified patent and that said Letters Patent is hereby corrected as shown below:

Column 20,
Line 26, “caper,” should read -- paper, --.
Line 54, “can” should read -- can be --.
Line 61, “halt” should read -- belt --.

Column 21,
Line 47, “form” should read -- from --.

Column 22,
Line 5, “reset if” should read -- reset. If --.
Line 28, “he” should read -- the --.
Line 47, “or” should read -- of --.

Column 24,
Line 12, “reach” should read -- reaches --.
Line 16, “operators,” should read -- operation, --.
Line 36, “Ts≦Th,” should read -- Ts<Th, --.

Column 25,
Line 60, “heats” should read -- heat is --.
Line 64, “hear” should read -- heat --.
Line 67, “elements.” should read -- element. --.

Column 26,
Line 7, “medium,” should read -- medium --.
Line 32, “go” should read -- to --.

Column 27,
Line 63, “the” (first occurrence) should read -- or the --.

Column 28,
Line 15, “applies” should read -- applied -- and “heat” should read -- head --.
Line 31, “or” (first occurrence) should read -- of --.

UNITED STATES PATENT AND TRADEMARK OFFICE

CERTIFICATE OF CORRECTION

PATENT NO. : 6,871,936 B2
DATED : March 29, 2005
INVENTOR(S) : Fujimoto et al.

It is certified that error appears in the above-identified patent and that said Letters Patent is hereby corrected as shown below:

Column 29,
Line 15, "change" should read -- changes --.
Line 16, "modification" should read -- modifications --.

Signed and Sealed this

Third Day of January, 2006

JON W. DUDAS
*Director of the United States Patent and Trademark Office*